US008561236B2

(12) United States Patent
Witherell et al.

(10) Patent No.: US 8,561,236 B2
(45) Date of Patent: Oct. 22, 2013

(54) STEPPED-EDGE AND SIDE-SUPPORT MEMBERS, ASSEMBLIES, SYSTEMS, AND RELATED METHODS, PARTICULARLY FOR BEDDING AND SEATING

(75) Inventors: Timothy Michael Witherell, Gastonia, NC (US); Julian Thomas Young, Zebulon, NC (US); Christopher Dean Page, Nashville, NC (US); Ivan Sobran, Raleigh, NC (US); Randal Lee Henderson, Zebulon, NC (US)

(73) Assignee: Nomaco Inc., Zebulon, NC (US)

( * ) Notice: Subject to any disclaimer, the term of this patent is extended or adjusted under 35 U.S.C. 154(b) by 621 days.

(21) Appl. No.: 12/615,535

(22) Filed: Nov. 10, 2009

(65) Prior Publication Data

US 2010/0319137 A1 Dec. 23, 2010

Related U.S. Application Data

(60) Provisional application No. 61/219,090, filed on Jun. 22, 2009.

(51) Int. Cl.
*A47C 23/04* (2006.01)

(52) U.S. Cl.
USPC ..... 5/717; 5/716; 5/739; 5/727; 5/728; 5/729; 5/730

(58) Field of Classification Search
USPC ..... 5/717, 716, 739, 727–730
See application file for complete search history.

(56) References Cited

U.S. PATENT DOCUMENTS

| | | | | |
|---|---|---|---|---|
| 554,580 | A | 2/1896 | Conkwright | |
| 676,573 | A | 6/1901 | Bowers | |
| 1,371,362 | A * | 3/1921 | Giese | 5/727 |
| 1,429,776 | A | 9/1922 | Robinson | |

(Continued)

FOREIGN PATENT DOCUMENTS

| | | | |
|---|---|---|---|
| EP | 1674003 | B1 | 5/2013 |
| GB | 2095545 | A | 10/1982 |

(Continued)

OTHER PUBLICATIONS

Notice of Allowance for U.S. Appl. No. 29/403,050 mailed Sep. 28, 2012, 8 pages.

(Continued)

*Primary Examiner* — Robert G Santos
*Assistant Examiner* — David E Sosnowski
(74) *Attorney, Agent, or Firm* — Withrow & Terranova, PLLC

(57) ABSTRACT

Stepped-edge and side-support members, systems, assemblies, and related methods for an innerspring assembly or other core are disclosed. In one embodiment, an innerspring assembly or core is provided having an interior area of a first height surrounded by one or more exterior, perimeter area(s) of shorter height(s) to provide a stepped-edge innerspring assembly or core. At least a portion of side-support members are placed onto at least a portion of the top surface of the perimeter area to provide edge-support for the innerspring assembly or core. In this manner, a greater portion of the side-support members can be disposed in the sleeping area of the innerspring assembly or core since the underlying perimeter area provides spring support to the side-support members. Further, this support can assist in retention and/or recovery of the shape of the side-support members to further prevent or reduce compression set of the side-support members.

38 Claims, 35 Drawing Sheets

(56) References Cited

U.S. PATENT DOCUMENTS 1,979,566 A 11/1934 Morse
1,986,255 A * 1/1935 Durfey et al. ..... 5/717
D105,428 S 7/1937 Bahr
D136,717 S 11/1943 Moore et al.
2,337,525 A 12/1943 Peik
2,539,058 A 1/1951 Burns
2,569,021 A 9/1951 Rozanski
2,615,577 A 10/1952 Bartleman
2,630,145 A 3/1953 Stevens
2,826,769 A 3/1958 Drews
2,940,089 A 6/1960 Koenigsberg
2,978,714 A 4/1961 Bechik
3,046,574 A 7/1962 Erenberg et al.
3,082,438 A 3/1963 Nachman, Jr.
3,293,671 A 12/1966 Griffin
3,318,224 A 5/1967 Bohanon
3,749,301 A 7/1973 Peckar
3,775,526 A 11/1973 Gilmore
3,822,426 A 7/1974 Mistarz
3,848,283 A 11/1974 Ikeda
3,894,706 A 7/1975 Mizusawa
D240,681 S 7/1976 Granatelli
D241,314 S 9/1976 Hug
D245,747 S 9/1977 Ikeda
4,121,005 A 10/1978 Roberts
4,181,992 A 1/1980 Blake
4,194,255 A 3/1980 Poppe
4,207,636 A 6/1980 Ceriani
4,275,473 A 6/1981 Poirier
D273,659 S 5/1984 Sakaguchi
4,451,946 A 6/1984 Stumpf
4,821,988 A 4/1989 Jimenez
4,907,309 A 3/1990 Breckle
4,915,662 A 4/1990 Kent
D307,688 S 5/1990 Schaefer
D307,690 S 5/1990 Raburn
D310,313 S 9/1990 Afeyan
4,998,310 A * 3/1991 Olson ..... 5/710
5,005,793 A 4/1991 Shillington
5,039,366 A 8/1991 Strattman
5,040,255 A * 8/1991 Barber, Jr. ..... 5/720
5,048,167 A 9/1991 Heffley et al.
D322,907 S 1/1992 Raburn
5,115,524 A 5/1992 Antosko
5,133,116 A 7/1992 Wagner et al.
5,195,197 A 3/1993 Gutierrez et al.
5,231,718 A 8/1993 Blaha et al.
5,239,715 A 8/1993 Wagner
5,398,820 A 3/1995 Kiss
5,415,370 A 5/1995 Valiulis
D363,016 S 10/1995 Sipprelle, III et al.
5,456,437 A 10/1995 Chander et al.
5,462,212 A 10/1995 Hertel, Jr.
5,467,488 A 11/1995 Wagner
5,469,590 A 11/1995 Simon
5,491,852 A 2/1996 Maucher
5,537,699 A 7/1996 Bonaddio et al.
D376,309 S 12/1996 Takai
5,642,557 A 7/1997 Clews
5,687,439 A 11/1997 Wagner
5,705,252 A 1/1998 Lea et al.
5,724,686 A 3/1998 Neal
5,743,497 A 4/1998 Michael
5,756,022 A 5/1998 Siegel et al.
5,787,532 A 8/1998 Langer et al.
5,792,309 A 8/1998 Eto
5,815,865 A 10/1998 Washburn et al.
5,861,205 A 1/1999 Murata et al.
D406,051 S 2/1999 Ross
5,924,682 A 7/1999 Bullard
D413,035 S 8/1999 Weterrings et al.
5,987,678 A 11/1999 Ayers
D417,612 S 12/1999 Jones
6,003,179 A 12/1999 Farley
D418,354 S 1/2000 O'Rourke
6,023,803 A 2/2000 Barman
6,026,525 A 2/2000 Davis
6,109,569 A 8/2000 Sakaida
6,122,787 A 9/2000 Kao
D432,404 S 10/2000 Garfinkle
6,154,908 A * 12/2000 Wells ..... 5/720
6,158,071 A * 12/2000 Wells ..... 5/717
D436,772 S 1/2001 Soderstrom
6,202,238 B1 * 3/2001 Mossbeck et al. ..... 5/717
6,243,894 B1 6/2001 Kosumsuppamala et al.
6,260,331 B1 7/2001 Stumpf
6,263,533 B1 7/2001 Dimitry et al.
6,286,166 B1 9/2001 Henley et al.
6,295,676 B1 * 10/2001 Warner ..... 5/720
6,306,235 B1 10/2001 Henderson
6,315,275 B1 11/2001 Zysman
D454,740 S 3/2002 Baggott
6,353,952 B1 * 3/2002 Wells ..... 5/716
D456,197 S 4/2002 McClure et al.
6,370,717 B1 4/2002 Kao
6,398,199 B1 6/2002 Barber
D467,117 S 12/2002 Guy
6,488,031 B1 12/2002 Sells, II
6,496,993 B2 12/2002 Allen et al.
6,523,812 B1 2/2003 Spinks et al.
6,537,405 B1 3/2003 Henderson et al.
6,568,014 B1 5/2003 Sabalaskey et al.
6,574,814 B2 6/2003 Collard et al.
6,612,525 B2 9/2003 Bagdi
6,658,682 B1 12/2003 Wells
6,684,434 B2 2/2004 Ellis et al.
6,721,981 B1 4/2004 Greenhalgh et al.
6,772,463 B2 8/2004 Gladney et al.
6,804,847 B2 * 10/2004 Grothaus ..... 5/655.8
6,813,791 B2 * 11/2004 Mossbeck et al. ..... 5/720
6,826,796 B1 12/2004 Mossbeck
6,832,397 B2 12/2004 Gaboury et al.
6,862,763 B2 3/2005 Mossbeck et al.
6,883,196 B2 4/2005 Barber
6,898,813 B2 5/2005 Grothaus
D506,385 S 6/2005 Brown
6,954,957 B2 10/2005 Metzger et al.
6,966,090 B2 11/2005 McClintock et al.
6,966,091 B2 11/2005 Barber
7,017,205 B2 3/2006 Gladney
7,028,352 B2 4/2006 Kramer et al.
7,036,173 B2 5/2006 Gladney
7,044,557 B2 5/2006 Wieland
7,082,635 B2 * 8/2006 Barman et al. ..... 5/717
7,093,858 B1 8/2006 Russell
7,127,765 B2 10/2006 Ruiz
7,165,282 B2 1/2007 Watson
D537,331 S 2/2007 Hill
7,178,187 B2 2/2007 Barman et al.
7,185,379 B2 * 3/2007 Barman ..... 5/717
7,185,770 B1 3/2007 Roten
7,194,777 B2 3/2007 Edling et al.
7,210,181 B1 5/2007 Price
7,251,847 B2 * 8/2007 Wells ..... 5/716
D569,160 S 5/2008 Mossbeck
D581,715 S 12/2008 Scheuch
D583,607 S 12/2008 Hanson et al.
7,546,648 B2 6/2009 Steffes
7,597,296 B2 10/2009 Conway
7,608,782 B2 10/2009 Hill
7,644,461 B2 1/2010 Lee
D612,188 S 3/2010 Yiannaki
7,685,664 B2 3/2010 Stolpmann et al.
7,805,790 B2 * 10/2010 DeMoss ..... 5/716
7,841,031 B2 11/2010 Rawls-Meehan
7,845,035 B2 12/2010 Letton et al.
7,845,036 B2 12/2010 Rinchetti
7,865,988 B2 1/2011 Koughan et al.
7,870,626 B2 * 1/2011 Antinori ..... 5/717
D636,622 S 4/2011 Quinter et al.
D640,535 S 6/2011 Austro
D642,413 S 8/2011 Rinehart
D642,847 S 8/2011 Rinehart
7,992,712 B2 8/2011 Rosland

(56) References Cited

U.S. PATENT DOCUMENTS

| | | | | |
|---|---|---|---|---|
| 8,001,638 | B1 | 8/2011 | Quinter et al. | |
| D648,211 | S | 11/2011 | Weaver et al. | |
| D653,895 | S | 2/2012 | Reisenhus | |
| D665,449 | S | 8/2012 | Guirlinger | |
| 8,250,689 | B2 | 8/2012 | Gladney | |
| 8,266,747 | B1 * | 9/2012 | Sobran et al. | 5/739 |
| 8,356,372 | B2 | 1/2013 | Smalling et al. | |
| 2002/0069462 | A1 | 6/2002 | Gaboury et al. | |
| 2003/0074736 | A1 | 4/2003 | Grothaus | |
| 2003/0079284 | A1 | 5/2003 | Gaboury et al. | |
| 2003/0173814 | A1 | 9/2003 | Wieland et al. | |
| 2004/0128761 | A1 | 7/2004 | Gaboury et al. | |
| 2004/0128773 | A1 | 7/2004 | Barber | |
| 2004/0133988 | A1 | 7/2004 | Barber | |
| 2004/0182802 | A1 | 9/2004 | Paul | |
| 2004/0187217 | A1 | 9/2004 | Barman et al. | |
| 2004/0261186 | A1 | 12/2004 | Gladney | |
| 2005/0015884 | A1 | 1/2005 | Conaway et al. | |
| 2005/0028275 | A1 | 2/2005 | Hooper, Jr. | |
| 2005/0204475 | A1 | 9/2005 | Schmitz et al. | |
| 2005/0246839 | A1 * | 11/2005 | Niswonger | 5/716 |
| 2005/0251920 | A1 | 11/2005 | Ahn | |
| 2005/0262642 | A1 | 12/2005 | Miller | |
| 2006/0031995 | A1 | 2/2006 | Barkhouse | |
| 2006/0042016 | A1 | 3/2006 | Barman et al. | |
| 2006/0260062 | A1 * | 11/2006 | Barman et al. | 5/717 |
| 2007/0118987 | A1 | 5/2007 | Gladney et al. | |
| 2008/0040861 | A1 | 2/2008 | Ootayopas | |
| 2008/0115288 | A1 | 5/2008 | Poulos | |
| 2009/0000030 | A1 | 1/2009 | Hicks et al. | |
| 2009/0011203 | A1 | 1/2009 | Mock et al. | |
| 2009/0013476 | A1 | 1/2009 | Rinchetti | |
| 2009/0025150 | A1 | 1/2009 | Smalling et al. | |
| 2009/0031502 | A1 | 2/2009 | Berrcocal et al. | |
| 2009/0100606 | A1 | 4/2009 | An | |
| 2009/0106894 | A1 | 4/2009 | Yeo | |
| 2009/0139033 | A1 | 6/2009 | Gladney | |
| 2009/0294623 | A1 | 12/2009 | Pinchuk | |
| 2010/0071136 | A1 | 3/2010 | Weber | |
| 2010/0077552 | A1 | 4/2010 | Malikhin et al. | |
| 2010/0223732 | A1 * | 9/2010 | Allman et al. | 5/717 |
| 2010/0319137 | A1 | 12/2010 | Witherell et al. | |
| 2010/0325806 | A1 | 12/2010 | Letton et al. | |
| 2011/0049327 | A1 | 3/2011 | Young et al. | |
| 2011/0061163 | A1 * | 3/2011 | Lee | 5/93.1 |
| 2011/0179579 | A1 | 7/2011 | Henderson et al. | |
| 2011/0197368 | A1 | 8/2011 | Tarazona De La Asuncion | |
| 2012/0167312 | A1 * | 7/2012 | Sobran et al. | 5/739 |
| 2012/0180224 | A1 | 7/2012 | Demoss et al. | |
| 2012/0284928 | A1 * | 11/2012 | Henderson et al. | 5/717 |

FOREIGN PATENT DOCUMENTS

| | | | |
|---|---|---|---|
| GB | 2154443 | A | 9/1985 |
| WO | 2009014657 | A1 | 1/2009 |
| WO | 2010117352 | A1 | 10/2010 |

OTHER PUBLICATIONS

Notice of Allowance for U.S. Appl. No. 29/361,180 mailed Nov. 27, 2012, 6 pages.
Notice of Allowance for U.S. Appl. No. 13/418,649 mailed Dec. 12, 2012, 7 pages.
Non-final Office Action for U.S. Appl. No. 12/870,316 mailed Aug. 21, 2012, 12 pages.
Notice of Allowance for U.S. Appl. No. 29/398,649 mailed Aug. 29, 2012, 6 pages.
Notice of Allowance for U.S. Appl. No. 29/398,647 mailed Aug. 30, 2012, 6 pages.
Non-final Office Action for U.S. Appl. No. 29/398,647 mailed May 8, 2012, 6 pages.
Notice of Allowance mailed May 9, 2012, for U.S. Appl. No. 29/398,649, 8 pages.
Notice of Allowance for U.S. Appl. No. 29/342,503 mailed Dec. 16, 2009, 6 pages.
Non-final Office Action for U.S. Appl. No. 13/418,649 mailed May 15, 2012, 15 pages.
"C-Clip 5.0 inch," Product Specifications, Nomaco, Inc., Jul. 9, 2009, 3 pages.
"Corner 'S: Tube 4.5 inch Final Spec," Product Specifications, Nomaco Inc., Mar. 2, 2010, 1 page.
"Mattress Innerspring/Innercore having Side and Corner Support Profiles," Nomaco, Inc., Jan. 2009, 1 page.
"Ultra Corner II 5.5 inch," Product Specifications, Nomaco, Inc., Mar. 3, 2010, 1 page.
Final Office Action mailed Nov. 8, 2011 for U.S. Appl. No. 12/455,968, 13 pages.
Non-final Office Action mailed May 26, 2010 for U.S. Appl. No. 12/455,968. 13 pages.
Non-final Office Action mailed Oct. 12, 2011 for U.S. Appl. No. 12/455,968, 12 pages.
Notice of Allowance mailed Dec. 31, 2009 for U.S. Appl. No. 29/342,503, 4 pages.
Non-final Office Action mailed Sep. 13, 2011 for U.S. Appl. No. 12/386,584, 18 pages.
Non-final Office Action for U.S. Appl. No. 12/386,584 mailed Feb. 3, 2012, 17 pages.
"Expandable Grids Made of ETHOFOAM Brand Polyethylene Foam," ETHAFOAM, Dec. 1997, 7 pages.
"Horizontal polymer foam bases no sides shown (reference only)," Nomaco, Date Unknown, 1 page.
"Flagship series side supports shown on traditional coil innerspring with borderwire," Nomaco, Date Unknown, 1 page.
"Luxury foam side supports shown on both metal coil and on pocketed coil innerspring," Nomaco, Date Unknown, 2 pages.
Notice of Allowance for U.S. Appl. No. 12/455,968 mailed Jul. 23, 2012, 7 pages.
Quayle Action for U.S. Appl. No. 29/361,180 mailed Sep. 13, 2012, 11 pages.
Non-final Office Action for U.S. Appl. No. 12/694,562 mailed Feb. 28, 2013, 13 pages.
Non-final Office Action for U.S. Appl. No. 29/368,046 mailed Mar. 8, 2013, 6 pages.
Final Office Action for U.S. Appl. No. 12/870,316 mailed Feb. 13, 2013, 9 pages.
Non-final Office Action for U.S. Appl. No. 13/534,068 mailed Jun. 12, 2013, 8 pages.
Notice of Allowance for U.S. Appl. No. 29/368,046 mailed Jul. 1, 2013, 8 pages.
Advisory Action for U.S. Appl. No. 12/870,316 mailed May 29, 2013, 2 pages.
Non-final Office Action for U.S. Appl. No. 12/870,316 mailed Jun. 20, 2013, 9 pages.
Non-final Office Action for U.S. Appl. No. 29/368,030 mailed Apr. 19, 2013, 7 pages.
Non-final Office Action for U.S. Appl. No. 29/368,039 mailed Apr. 25, 2013, 8 pages.
Non-final Office Action for U.S. Appl. No. 29/368,034 mailed Apr. 24, 2013, 6 pages.
Notice of Allowance for U.S. Appl. No. 29/368,030 mailed Aug. 5, 2013, 8 pages.
Final Office Action for U.S. Appl. No. 29/368,039 mailed Aug. 5, 2013, 6 pages.

* cited by examiner

STEPPED-EDGE AND SIDE-SUPPORT MEMBERS, ASSEMBLIES, SYSTEMS, AND RELATED METHODS, PARTICULARLY FOR BEDDING AND SEATING

RELATED APPLICATION

The present application claims priority to U.S. Provisional Patent Application Ser. No. 61/219,090, filed on Jun. 22, 2009, entitled "Stepped-Edge and Side-Support Members, Assemblies, Systems, and Related Methods, Particularly for Bedding and Seating," which is incorporated herein by reference in its entirety.

BACKGROUND

1. Field of the Disclosure

The technology of the disclosure relates to stepped-edge and side-support members, assemblies, systems, and related methods and which may be employed in bedding and seating applications to provide support, including edge support.

2. Technical Background

Innerspring assemblies for mattresses or seating structures can be composed of a plurality of spring coils tied together in a matrix or array. An example of such an innerspring assembly in the prior art is illustrated by the mattress 10 of FIG. 1. As illustrated therein, a mattress innerspring 12 is provided. The innerspring 12 is comprised of a plurality of traditional coils 14 arranged in an interconnected matrix to form a flexible core structure and support surfaces of the mattress. The coils 14 are also connected to each other through interconnection helical wires 16. Upper and lower border wires 18, 20 are attached to upper and lower end turns of the coils 14 at the perimeter of the array to create a frame for the innerspring 12. The upper and lower border wires 18, 20 also create firmness on the perimeter of the innerspring 12 where an individual may disproportionally place force on the innerspring 12, such as during mounting onto and dismounting from the mattress 10. The innerspring 12 is disposed on top of a box spring 22 to provide base support.

To provide further perimeter structure and edge-support for the innerspring 12, innerspring support members 24 may be disposed around the perimeter coils 14 of the innerspring 12 between the box spring 22 and the upper and lower border wires 18, 20. The innerspring support members 24 may be extruded from polymer-foam as an example. One or more layers of sleeping surface or padding material 26 are disposed on top of the innerspring 12, and upholstery (not shown) is placed around the entire padding material 26, innerspring 12, and box spring 22 to provide a fully assembled mattress 10. This mattress structure in FIG. 1 may also be provided for other types of innersprings, including pocketed coils.

Whether wire coils, pocketed coils, or any other type of innerspring, it may be desirable to reduce costs of the innerspring. For example, eliminating border wires can save costs. Eliminating border wire reduces metal costs in the innerspring assembly and reduces manufacturing labor costs and complications by eliminating the step of attaching the border wires during assembly. Eliminating border wires may also lessen the overall weight of the innerspring assembly thus saving shipping costs. However, eliminating border wires may reduce firm edge structure and support. The cost of an innerspring assembly may also be reduced by eliminating some of the perimeter metal innerspring coils for similar reasons as eliminating border wires. The eliminated innerspring coils may be replaced with other less expensive materials, such as polymer foams as an example. Such materials may also be used to provide side structure and support. However, eliminating innerspring coils in the innerspring assembly reduces the sleep surface supported by coil springs. It may be undesirable, unacceptable, or otherwise impractical to reduce the sleep surface of an innerspring assembly by eliminating perimeter innerspring coils. As one example, basic foam side-supports that are not engineered for longevity can incur compression set over time. This may be unacceptable for edge-support for an innerspring assembly.

SUMMARY OF THE DETAILED DESCRIPTION

Embodiments in the detailed description include stepped-edge and side-support members, systems, assemblies, and related methods for an innerspring assembly or other core. The innerspring assemblies or cores can be employed for bedding and seating assemblies and applications, as examples. In one embodiment, an innerspring assembly or core is provided having an interior area of a first height surrounded by one or more exterior, perimeter area(s) of shorter height(s) than the interior area to provide a stepped-edge innerspring assembly or core. At least a portion of side-support members are placed onto at least a portion of the top surface of the perimeter area to provide edge-support for the innerspring assembly or core. In this manner, a greater portion of the side-support members can be disposed in the sleeping area of the innerspring assembly or core since the underlying perimeter area provides spring or spring-like support to the side-support members. Further, this support can assist in retention and/or recovery of the shape of the side-support members to further prevent or reduce compression set of the side-support members over a long period of time. Spring material or core costs may be saved by providing shorter height perimeter area of the innerspring assembly or core with the addition of less expensive side-support material. This structure can also be employed to provide a transition area between the innerspring assembly or core and the edge-supports. Further, the side-support members can also be designed with a profile such that the top surfaces of the side-support members are arranged to be planar or substantially planar with the interior area of the innerspring assembly or core. In this manner, side-supports are provided for the innerspring assembly or core while providing a planar or substantially planar sleeping surface.

In one embodiment, a stepped-edge assembly is provided. The stepped-edge assembly comprises at least one interior area having an interior area height. The stepped-edge assembly also comprises at least one perimeter area adjacent to the at least one interior area and having a perimeter area height shorter than the interior area height to provide at least one stepped-edge. The stepped-edge assembly further includes at least one side-support member having a stepped-edge profile formed by a top portion arranged perpendicular or substantially perpendicular to a side portion. The stepped-edge profile of the at least one side-support member is placed adjacent to at least a portion of the at least one stepped-edge to provide edge-support.

In another embodiment, a method of assembling a bedding assembly is provided. The method includes placing at least one interior area having an interior area height on top of a base. At least one perimeter area having a perimeter area height shorter than the interior area height is placed on the base adjacent the at least one interior area to provide at least one stepped-edge. Further, at least one side-support member having a stepped-edge profile formed by a top portion arranged perpendicular or substantially perpendicular to a side portion is placed adjacent to at least a portion of the at least one stepped-edge to provide edge-support.

In another embodiment, a side-support member for providing edge support for cushioning is provided. The side-support member includes a top portion and a bottom portion arranged perpendicular or substantially perpendicular to a side portion to form a stepped-edge profile. A plurality of channels are provided and disposed in the side portion to provide spring-like support when a load is placed onto the top portion.

The stepped-edge disposed in the innerspring assembly by the arrangement of coil springs or cores may be a single or multiple stepped-edge, which is also called a stair stepped-edge. One or more intermediate areas may be disposed in the innerspring assembly or core. Intermediate areas can provide additional transition areas between the interior area or sleep surface and edge of the innerspring assembly. Providing intermediate areas in the innerspring assembly or core may assist in further reducing the amount of spring material or core to reduce costs while providing a spring-like surface to allow the side-support material to intrude further into the interior area or sleeping surface area of the innerspring assembly or core.

The interior and perimeter innerspring may be comprised of any type of innerspring desired, including but not limited to coil springs and pocketed coils, as examples. The interior and perimeter core may be comprised of latex or viscoelastic foam, as examples. The side-support members may be made from a firmer, lighter, and/or less expensive material than the innerspring or core. For example, the side-supports may be constructed from engineered polymer foam. In this manner, more expensive edge structures, like steel border-wires, firmer spring-coils, or other costly composites, as examples, can be avoided while still providing edge support for the innerspring or core. The addition of engineered side-supports onto stepped-edge innerspring assemblies and cores can also provide the ability to customize the desired firmness of the innerspring or core perimeter edge while also creating the potential to manufacture innerspring or core-based products that exhibit a longer lasting edge structure life. Additional features and advantages will be set forth in the detailed description which follows, and in part will be readily apparent to those skilled in the art from that description or recognized by practicing the invention as described herein, including the detailed description that follows, the claims, as well as the appended drawings.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

DETAILED DESCRIPTION OF THE EMBODIMENTS

Embodiments in the detailed description include stepped-edge and side-support members, systems, assemblies, and related methods for an innerspring assembly or other core. The innerspring assemblies or cores can be employed for bedding and seating assemblies and applications, as examples. In one embodiment, an innerspring assembly or core is provided having an interior area of a first height surrounded by one or more exterior, perimeter area(s) of shorter height(s) than the interior area to provide a stepped-edge innerspring assembly or core. At least a portion of side-support members are placed onto at least a portion of the top surface of the perimeter area to provide edge-support for the innerspring assembly or core. In this manner, a greater portion of the side-support members can be disposed in the sleeping area of the innerspring assembly or core since the underlying perimeter area provides spring or spring-like support to the side-support members. Further, this support can assist in retention and/or recovery of the shape of the side-support members to further prevent or reduce compression set of the side-support members over a longer period of time. Spring material or core costs may be saved by providing a shorter height perimeter area of the innerspring assembly or core with the addition of less expensive side-support material. This structure can also be employed to provide a transition area between the innerspring assembly or core and the edge-supports. Further, the side-support members can also be designed with a profile such that the top surfaces of the side-support members are arranged to be planar or substantially planar with the interior area of the innerspring assembly or core. In this manner, side-supports are provided for the innerspring assembly or core while providing a planar or substantially planar sleeping surface.

The interior and perimeter innerspring may be comprised of any type of innerspring desired, including but not limited to coil springs and pocketed coils, as examples. The interior and perimeter core may be comprised of latex or viscoelastic foam, as examples. The side-support members may be made from a firmer, lighter, and/or less expensive material than the innerspring or core. For example, the side-supports may be constructed from engineered polymer foam. In this manner, more expensive edge structures, like steel border-wires, firmer spring-coils, or other costly composites, as examples, can be avoided while still providing edge support for the innerspring or core. The addition of engineered side-supports onto stepped-edge innerspring assemblies and cores can also provide the ability to customize the desired firmness of the innerspring or core perimeter edge while also creating the potential to manufacture innerspring or core-based products that exhibit a longer lasting edge structure life.

Figure 1:
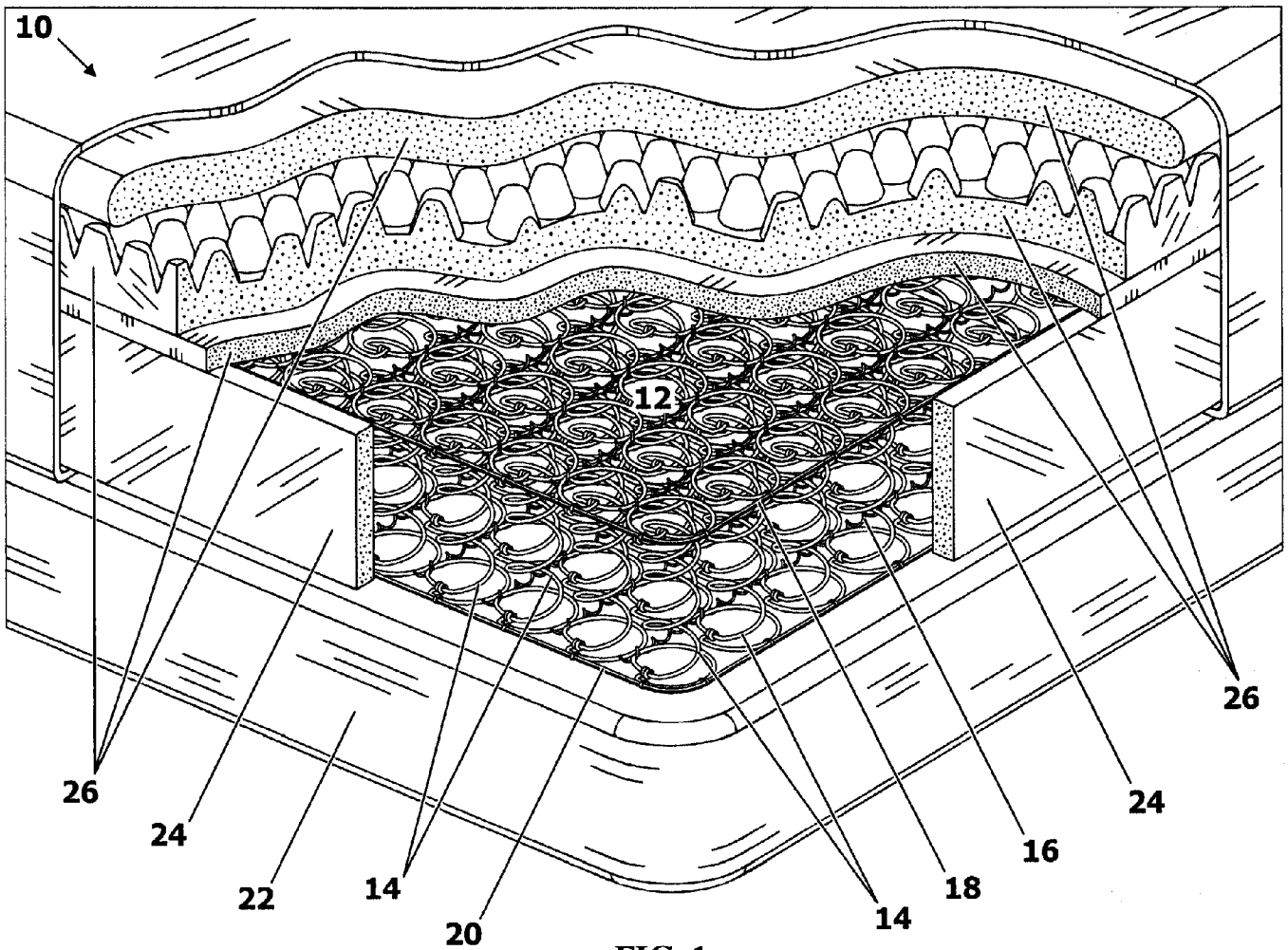
FIG. 1 PRIOR ART
FIG. 1 is a an exemplary mattress in the prior art employing an innerspring of steel wire coils.
Figure 2A:
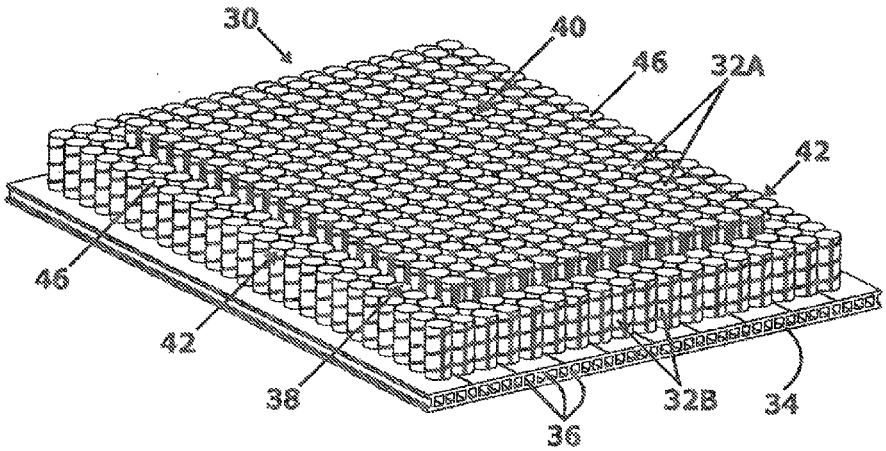
FIGS. 2A and 2B are perspective views of an exemplary stepped-edge innerspring assembly without and with installed one-piece L-shaped side-support members on the perimeter of the innerspring assembly, according to one embodiment.
Figure 2B:
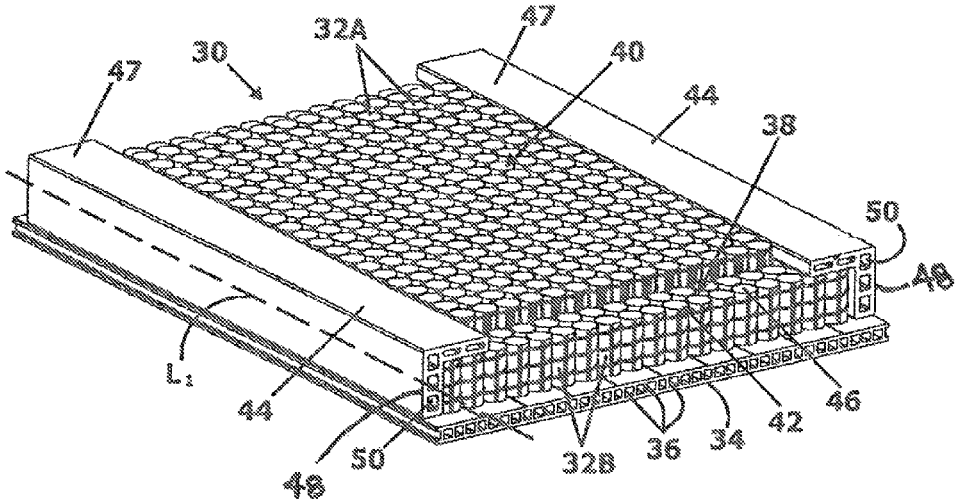

In this regard, FIGS. 2A and 2B are perspective views of an exemplary stepped-edge innerspring assembly 30 without and with side-support members on the perimeter of the stepped-edge innerspring assembly 30, according to one embodiment. As illustrated in FIG. 2A, the stepped-edge innerspring assembly 30 is provided. In this embodiment, the innerspring assembly 30 is comprised of a plurality of pocketed coils 32; however, traditional coils arranged in an interconnected matrix or any other type of innerspring could be provided. The pocketed coils 32 are attached to a base or deck 34 to provide support for the pocketed coils 32 as part of the innerspring assembly 30. The pocketed coils 32 provide spring support for a sleeping surface provided by the innerspring assembly 30.

As an example, the base 34 may be manufactured from extruded polymer foam. As examples of the wide variety of alternate compositions that can be employed and effectively used, the base 34 may be formed from one or more materials selected from the group consisting of polystyrenes, polyefins, polyethylenes, polybutanes, polybutylenes, polyurethanes, polyesters, ethylene acrylic copolymers, ethylene-vinyl-acetate copolymers, ethylene-methyl acrylate copolymers, ethylene-butyl-acrylate copolymers, ionomers, polypropylenes, copolymers of polypropylene, and the like. Such polymers may be foamed to provide the base 34 including either open-cell foam, closed-cell foam, or both open and closed-cell foam. An example of an extruded polymer base and method of manufacture of same are disclosed in U.S. Pat. No. 6,537,405 entitled "Spiral Formed Products and Method of Manufacture," and U.S. Pat. No. 6,306,235 entitled "Spiral Formed Products and Method of Manufacture," both of which are incorporated herein by reference in its entirety. The density of the base 34 may be any density desired. Channels 36 may be extruded from the base 34 to provide a spring-like structure in the base 34 while using less polymer material to save costs. The pocketed coils 32 may be attached to the base 34 using an adhesive or other fastener means as an example.

The innerspring assembly 30 includes a stepped-edge 38 provided by an interior area 40 of interior pocketed coils 32A surrounded by an exterior, perimeter area 42 of perimeter pocketed coils 32B. The interior pocketed coils 32A disposed in the interior area 40 may form the area of the sleep surface provided by the innerspring assembly 30 in this embodiment. The interior pocketed coils 32A disposed in the interior area 40 are taller than the perimeter pocketed coils 32B disposed in the perimeter area 42 in this embodiment. For example, the taller interior pocketed coils 32A disposed in the interior area 40 include an interior area height $H_i$ which may be five to three hundred fifty percent (5-350%) taller than the shorter, at least one perimeter area height $H_p$ of the perimeter pocketed coils 32B disposed in the perimeter area 42. For example, the taller, interior pocketed coils 32A disposed in the interior area 40 may be six to nine inches (6"-9") tall, and the shorter, perimeter pocketed coils 32B disposed in the perimeter area 42 may be two to five and three-quarter inches (2"-5¾") tall. In this manner, less metal may be employed in the perimeter pocketed coils 32B contained in the perimeter area 42 of the innerspring assembly 30. An adhesive may be placed or sprayed on the base 34 and rows of pocketed coils 32A, 32B attached to the base 34 until the pocketed coils 32A, 32B have all been attached to the base 34 in the interior area 40 and the perimeter area 42, respectively.

The interior pocketed coils 32A disposed in the interior area 40 may be the same coil structure and gauge as the perimeter pocketed coils 32B disposed in the perimeter area 42. The perimeter pocketed coils 32B may be placed under greater compression than the interior pocketed coils 32A to provide for the difference in height. Alternatively, the interior pocketed coils 32A may be taller than the perimeter pocketed coils 32B when not under compression, wherein both sets of pocketed coils 32A, 32B are compressibly displaced the same distance by pockets. Both sets of pocketed coils 32A, 32B may have the same degree or different degrees of firmness. One motiviation for this arrangement may be to save material costs in the innerspring assembly 30. Another motiviation for this arrangement may be to decrease the overall weight of the innerspring assembly 30 to reduce shipping costs and provide for easier movement of the innerspring assembly 30.

Figure 2C:
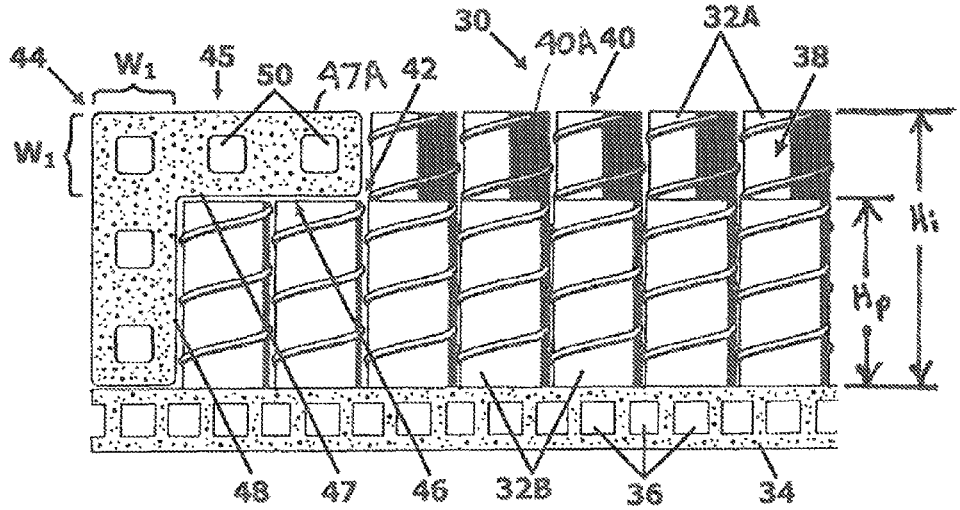
FIG. 2C is a partial side view of the stepped-edge innerspring assembly and side-support member of FIG. 2B.

It is generally desired to provide edge-support for innerspring assemblies. To provide edge-support to the innerspring assembly 30 of FIG. 2A, one or more side-support members 44 can be provided in the innerspring assembly 30, as illustrated in FIG. 2B. FIG. 2B illustrates two side-support members 44 attached on opposites sides of the innerspring assembly 30. In this embodiment, portions 45 of side-support members 44 are placed onto a top surface 46 of perimeter pocketed coils 32B of the innerspring assembly 30 to provide edge-support for the innerspring assembly 30, as illustrated in FIG. 2C. The side-support members 44 are L-shaped members in this embodiment that are attached in a complimentary manner to the stepped-edge 38 of the innerspring assembly 30. As examples of the wide variety of alternate compositions that can be employed and effectively used, the side-support members 44 may be formed from one or more materials selected from the group consisting of polystyrenes, polyefins, polyethylenes, polybutanes, polybutylenes, polyurethanes, polyesters, ethylene acrylic copolymers, ethylene-vinyl-acetate copolymers, ethylene-methyl acrylate copolymers, ethylene-butyl-acrylate copolymers, ionomers, polypropylenes, copolymers of polypropylene, and the like. One side 47 of the L-shaped side-support member 44 is placed on the top surface 46 of the perimeter pocketed coils 32B of the innerspring assembly 30. The other side 48 of the L-shaped side-support member 44 is disposed generally perpendicular to the longitudinal axis of the perimeter pocketed coils 32B down the side profile of the innerspring assembly 30 and resting on the base 34 to provide edge-support. The L-shaped side-support members 44 can be attached to the perimeter pocketed coils 32B, the stepped-edge 38, and the base 34 using an adhesive or other fastener means as an example. For example, an adhesive may be sprayed onto the exterior surfaces of the perimeter pocketed coils 32B, the stepped-edge 38, and the base 34 prior to installing the L-shaped side-support members 44. Several features can be accomplished by use of L-shaped side-support members 44 to fit in a complimentary manner with the stepped-edge 38, as discussed in detail below.

One feature of this arrangement is the disposition of a greater portion of the L-shaped side-support members 44 in the sleeping area of the innerspring assembly 30. Because portions of the L-shaped side-support members 44 are disposed on top of the shorter, perimeter pocketed coils 32B of the innerspring assembly 30, the shorter, perimeter pocketed coils 32 provide spring or spring-like support to the L-shaped side-support members 44. This support can assist in retention and/or recovery of the shape of the L-shaped side-support members 44 to further prevent or reduce compression set of the L-shaped side-support members 44 over a long period of time. This may be important to provide a longer lasting innerspring assembly 30 and make it more feasible to provide a larger area L-shaped side-support member 44 that intrudes into more of the sleep area of the innerspring assembly 30 to reduce costs. This structure can also be employed to provide transition areas $T_1$, $T_2$ between the interior area 40 of the innerspring assembly 30 and portions of the L-shaped side-support members 44 that are not vertically displaced on top of the perimeter pocketed coils 32B. For example, the interior area 40 may exhibit one degree of firmness, and as a load moves from the interior area 40 to the perimeter area 42, an intermediate degree of firmness may be provided by the transition area formed by the portion of the L-shaped side-support members 44 disposed on the perimeter pocketed coils 32B in the perimeter area 42. The highest degree of firmness may be provided by the portions of the L-shaped side-support members 44 that are not disposed on the perimeter pocketed coils 32B and extend down the side profile of the innerspring assembly 30. Such an arrangement may make it acceptable to users to have an innerspring assembly 30 containing a greater amount or area of polymer side-support that intrudes into a greater portion of the sleeping area. Further, by providing the side-support members as L-shaped members, a top surface 47A of the L-shaped side-support members 44 can be arranged to be planar or substantially planar with a top portion 40A of the interior area 40 of the innerspring assembly 30. In this manner, edge-supports are provided for the innerspring assembly 30 which employs a shorter, perimeter pocketed coil 32B profile in the perimeter area 42 while providing a planar or substantially planar sleeping surface in the innerspring assembly 30.

The L-shaped side-support members 44 may also be extruded with longitudinal interior extrusion channels 50 extending along a longitudinal axis $L_1$, as illustrated in FIG. 2B, to provide further spring-like support to the perimeter area 42 of the innerspring assembly 30. The interior extrusion channels 50 can be provided of different designs, shapes and extrusions areas to provide the desired firmness or spring-like edge-support. Providing interior extrusion channels 50 also reduces material, and thus the cost of material, and reduces weight. The interior extrusion channels 50 provided in the portion of the L-shaped side-support members 44 disposed on the top surface 46 of the perimeter pocketed coils 32B may be designed to work in conjunction with the firmness provided by such perimeter pocketed coils 32B to provide the desired support and feel in this transition area of the innerspring assembly 30.

Figure 2D:
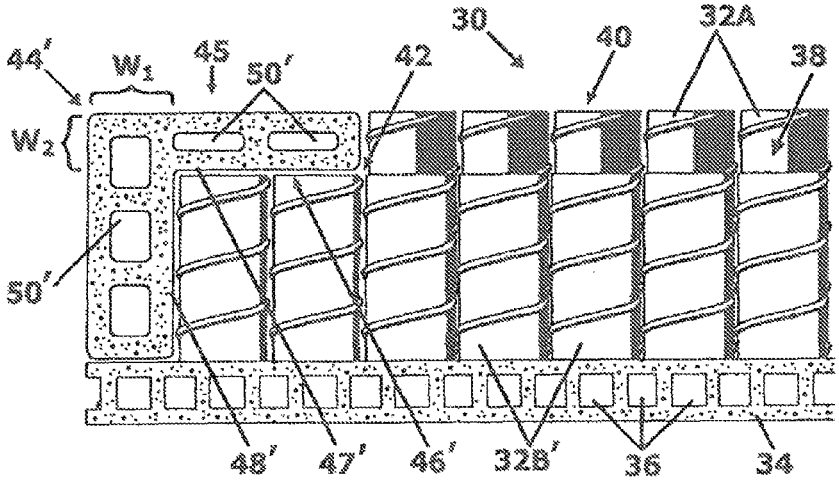
FIG. 2D is another partial side view of the stepped-edge innerspring assembly and side-support member of FIG. 2B.

In the embodiment of FIGS. 2A-2C, the portions of the L-shaped side-support member 44 that are attached adjacent the stepped-edge 38 have the same width $W_1$. However, these portions could be provided in the L-shaped side-support member 44 to be of differing widths. This is illustrated by the alternate L-shaped side-support member 44' in FIG. 2D. As illustrated in FIG. 2D, the side-support member 44' is provided in this embodiment as an L-shaped member and is attached in a complimentary manner to the stepped-edge 38 of the innerspring assembly 30, like provided by the L-shaped side-support member 44 in FIGS. 2A-2C. The L-shaped side-support members 44' may also be extruded with longitudinal interior extrusion channels 50' as illustrated in FIG. 2D, like provided in the L-shaped side-support member 44 in FIGS. 2A-2C. However, in this embodiment in FIG. 2D, a horizontal side 47' of the L-shaped side-support member 44' has a width $W_2$ which is sized differently than the width $W_1$ of a vertical side 48' of the L-shaped side-support member 44'. Providing the horiztonal side 47' of the L-shaped side-support member 44' of less width allows for providing taller perimeter pocketed coils 32B'. Providing taller perimeter pocketed coils 32B' may be desirable to provide a different firmness on the stepped-edge 38 of the innerspring assembly 30. Alternatively, providing the horiztonal side 47' of the L-shaped side-support member 44' of greater width allows for providing shorter perimeter pocketed coils 32B'. Providing shorter perimeter pocketed coils 32B' may be desirable to further reduce the pocketed coil materials, and therefore further reduce the cost of the perimeter pocketed coils 32B'. All other features indicated between common element numbers between the L-shaped side-support members 44, 44' in FIGS. 2A-2C and 2D, respectively, have been previously discussed with regard to L-shaped side-support member 44 in FIGS. 2A-2C and are applicable for the L-shaped side-support member 44' of FIG. 2D.

Figure 3A:
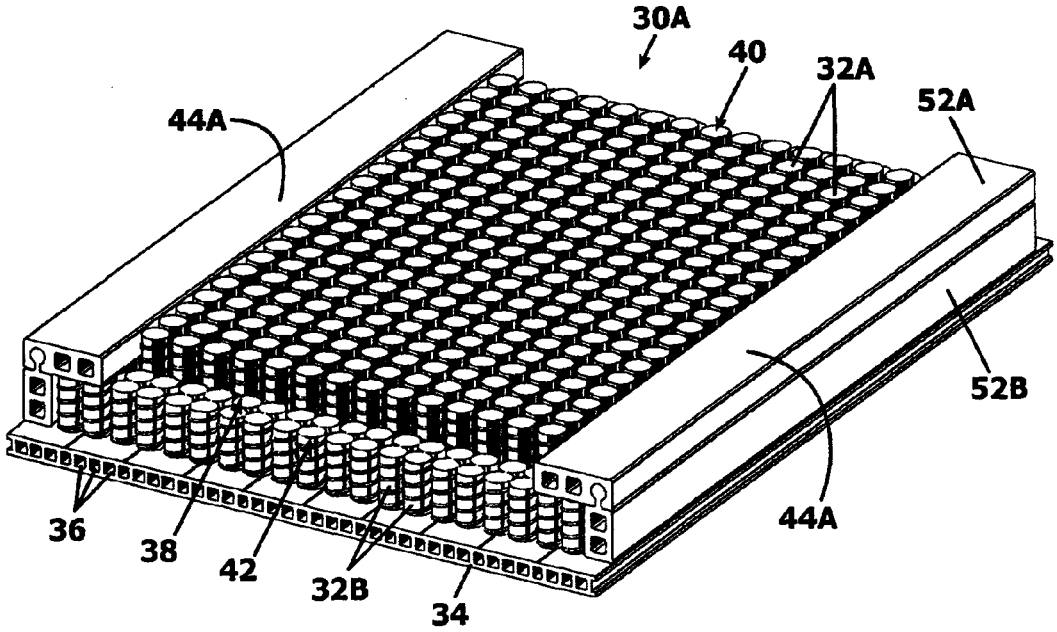
FIG. 3A is a perspective view of another stepped-edge innerspring assembly with alternate tongue and groove L-shaped side-support members installed on the perimeter of the innerspring assembly, according to another embodiment.
Figure 3B:
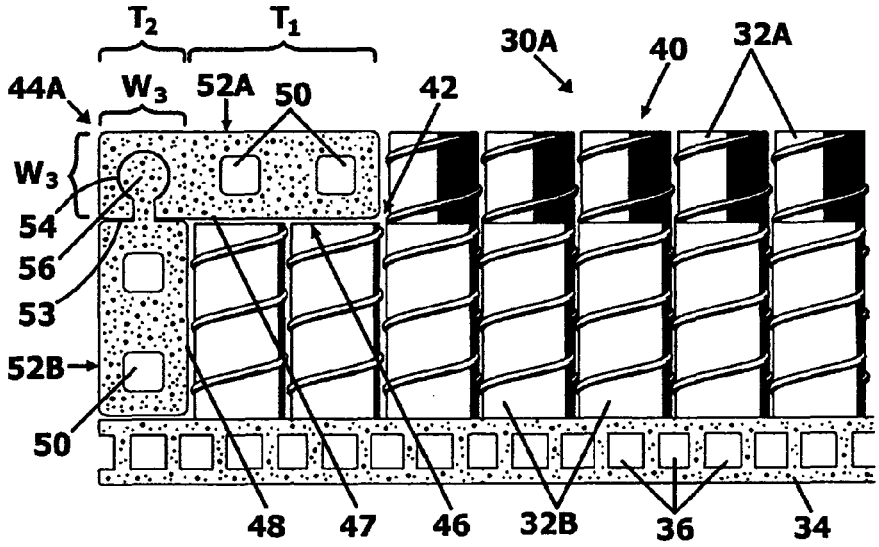
FIG. 3B is a partial side view of the stepped-edge innerspring assembly and side-support of FIG. 3A.

FIGS. 3A and 3B illustrate perspective and side views of another innerspring assembly 30A that includes the same pocketed coils 32A, 32B arrangement as provided in FIGS. 2A-2C, but with alternate L-shaped side-support members 44A installed on the perimeter pocketed coils 32B in the perimeter area 42. The features and functions of the innerspring assembly 30 and L-shaped side-support members 44 discussed above with respect to FIGS. 2A-2C are also equally applicable for this embodiment and thus will not be repeated. Common elements or features are provided in FIGS. 3A and 3B with common element numbers. However in this embodiment, the L-shaped side-support members 44A are provided as a two-piece structure comprised of a first member 52A and a second member 52B. The L-shaped side-support members 44 provided in FIGS. 2A-2C were one-piece side-support members. Turning back to FIGS. 3A and 3B, the first and second members 52A, 52B of the L-shaped side-support members 44A are attached together using a tongue and groove arrangement. The first member 52A contains a female channel 54 disposed longitudinally along the first member 52A that is adapted to receive a male member 56 disposed longitudinally along the second member 52B such that the first and second members 52A, 52B are disposed orthogonally or substantially orthogonally to each other to provide the L-shaped side-support member 44A. The first and second members 52A, 52B could also be welded together via a weld 53 or glued via a glue (not shown) disposed between the first and second members 52A, 52B to provide a secure attachment of the first and second members 52A, 52B together. The L-shaped side-support member 44A is configured to fit in a complimentary manner to the stepped-edge 38 of the innerspring assembly 30A like that provided by the L-shaped side-support members 44 and innerspring assembly 30 in FIGS. 2A-2C. In this embodiment, the first and second members 52A, 52B have the same width $W_3$, but alternatively, the first and second members 52A, 52B could be provided in the L-shaped side-support member 44A to be of differing widths.

Figures 4A, 4B, 4C:
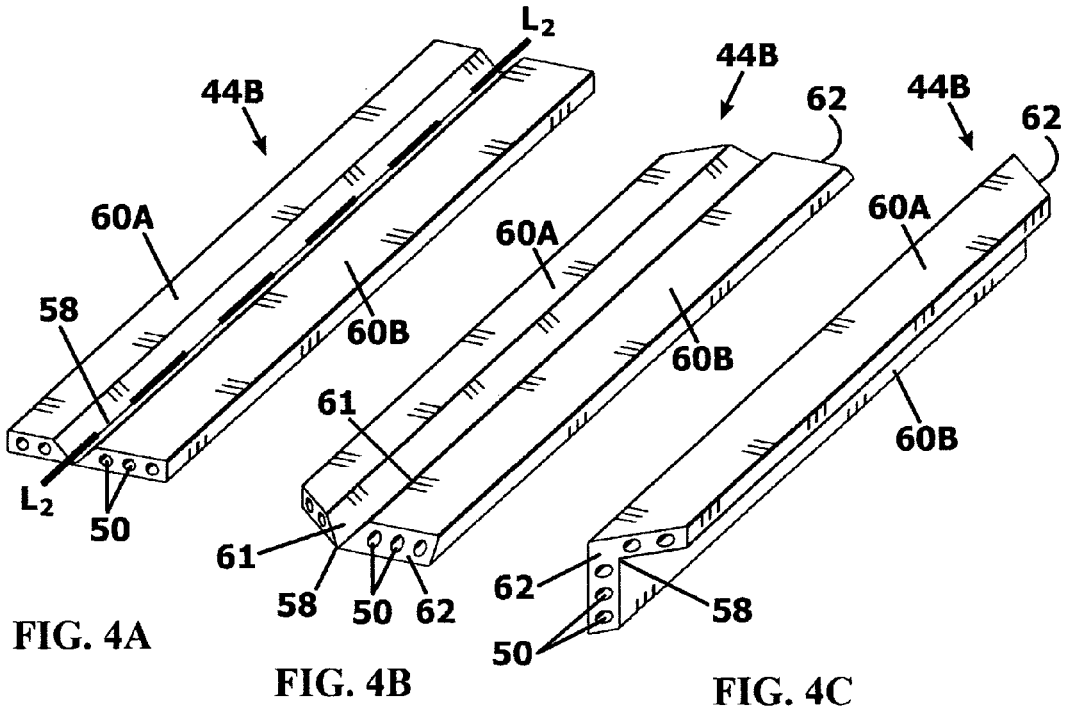
FIGS. 4A-4C illustrate another exemplary foldable L-shaped side-support with mitered ends, according to another embodiment.

FIGS. 4A-4C illustrate another exemplary L-shaped side-support member 44B that may be employed with the innerspring assemblies 30, 30A of FIGS. 2A through 3B, respectively. In this embodiment, a living hinge 58 can be disposed along a longitudinal axis $L_2$ of the L-shaped side-support member 44B. In this manner, the L-shaped side-support member 44B can be formed by folding a first member 60A about the living hinge 58 onto a second member 60B, as illustrated in FIG. 4C. When desired to conserve space during manufacturing, storage, or shipment of the L-shaped side-support members 44B, the first and second members 60A, 60B can be folded back out about the living hinge 58 to flatten the L-shaped side-support member 44B, as illustrated in FIG. 4A. Again, interior extrusion channels 50 can be extruded from the L-shaped side-support members 44B to provide a spring-like effect and/or to provide a desired degree of firmness. As an added labor savings benefit, side surfaces 61 of the living hinge 58 may be pre-layered with an adhesive or other fastening method so as to create an expeditious means by which the first member 60A is folded and fastened about the living hinge 58 onto the second member 60B, as illustrated in FIG. 4C. Further, ends 62 of the L-shaped side-support members 44B can be mitered by cut after the L-shaped side-support members 44B are formed, such as from polymer foam for example, so that each of the L-shaped side-support members 44B abut against each other at complimentary angles in the corners of the innerspring assembly 30, 30A, when installed. Providing mitered edges in this manner can prevent having to provide separate corner side-support members for the innerspring assembly 30.

Figure 5A:
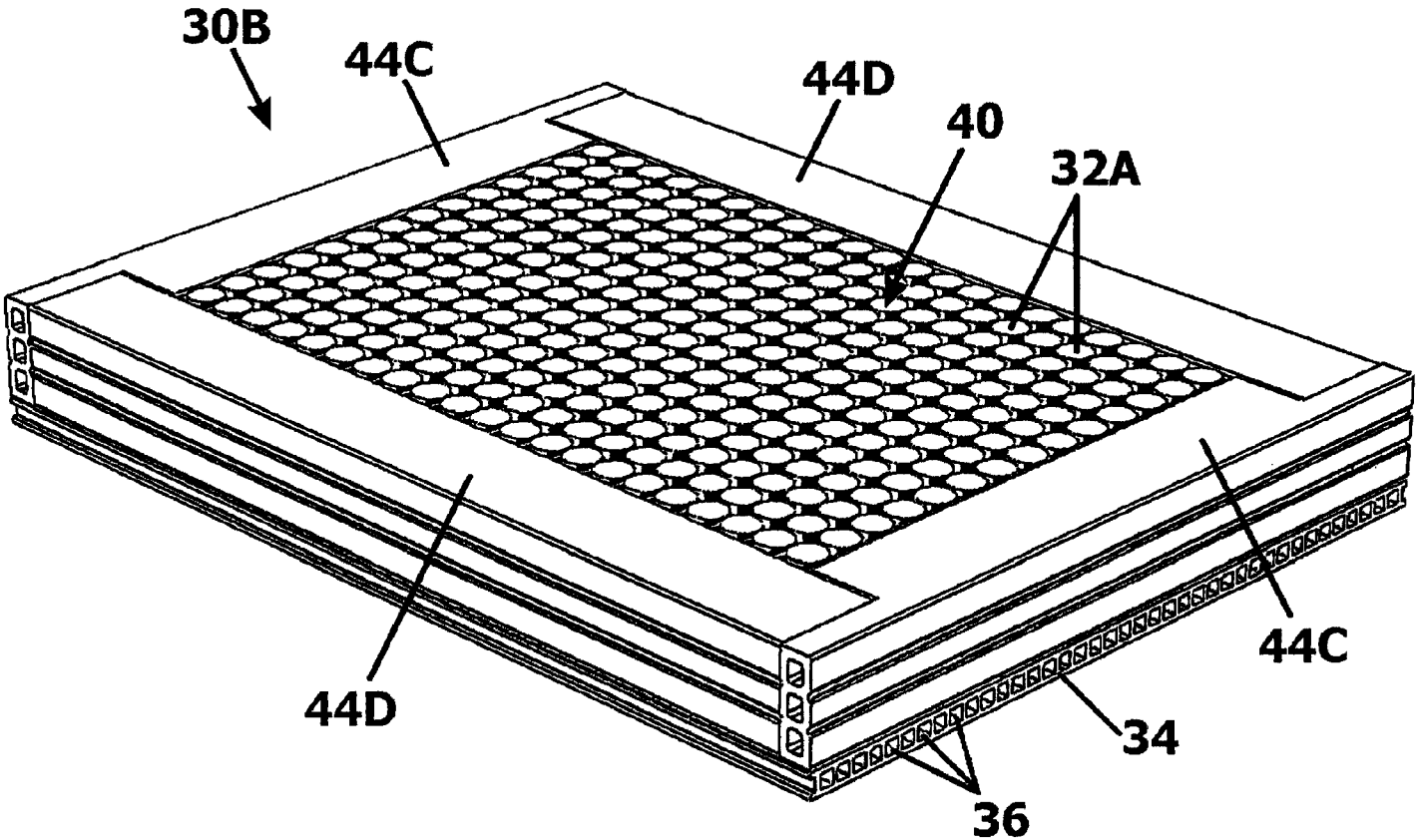
FIGS. 5A-5C are perspective views of another stepped-edge innerspring assembly with another alternate L-shaped side-support members installed on the perimeter of the innerspring assembly, according to another embodiment.
Figure 5B:
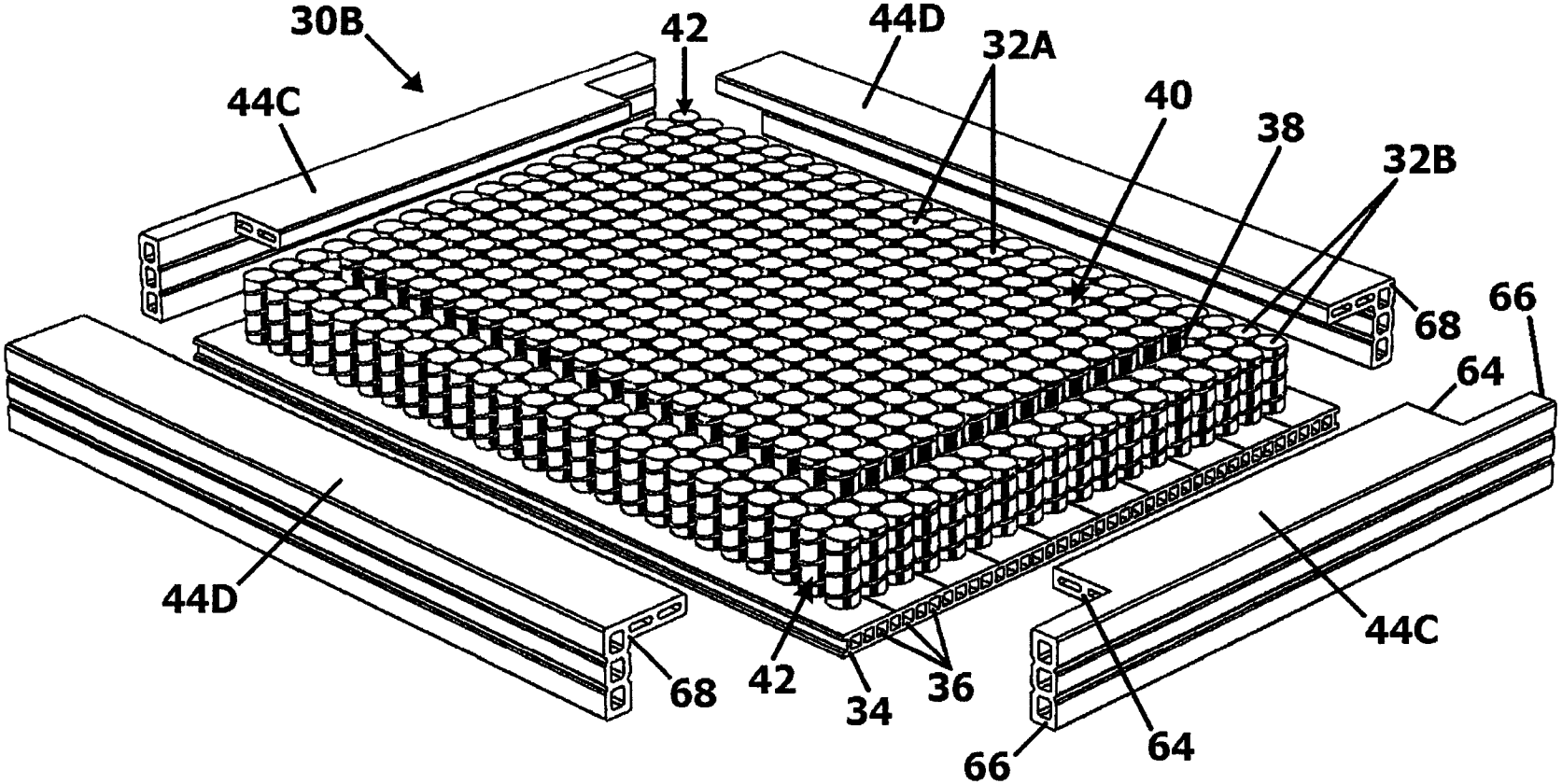
Figure 5C:
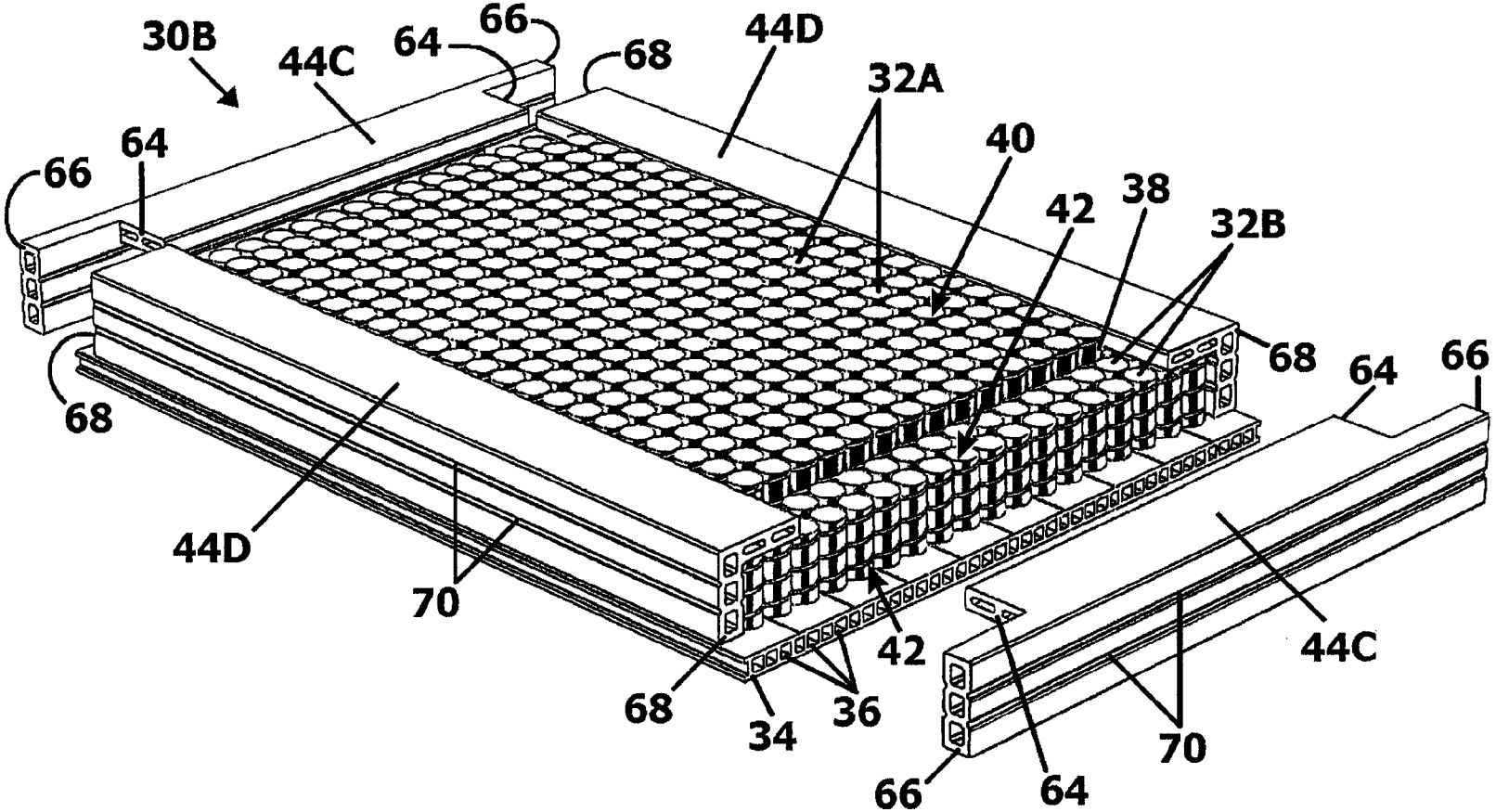

FIGS. 5A through 5C are perspective views of an alternate innerspring assembly 30B that may also be employed in accordance with embodiments disclosed herein. The pocketed coils 32A, 32B are provided in both an interior area 40 and perimeter area 42, respectively, just as provided in the previous innerspring assemblies 30, 30A. A stepped-edge 38 is also provided between the taller, interior pocketed coils 32A and the shorter, perimeter pocketed coils 32B as previously described. The innerspring assembly 30B also comprises the base 34 as previously described. However, in this embodiment, alternate L-shaped side-support members 44C, 44D are provided. End L-shaped side-support members 44C and side L-shaped side-support members 44D are provided. The side L-shaped side-support members 44D can be either the same or substantially the same as the L-shaped side-support members 44 in FIGS. 2A and 2B. The end L-shaped side-support members 44C have been altered after their extrusion as illustrated in FIG. 5B. Notches 64 are cut out of ends 66 of the end L-shaped side-support members 44C such that ends 68 of the side L-shaped side-support members 44D fit in a complimentary manner within the notches 64 of the end L-shaped side-support members 44C. The notches 64 may be cut out using a wire saw as an example. Thus, when the end L-shaped side-support members 44C and side L-shaped side-support members 44D are placed on the stepped-edge 38 of the innerspring assembly 30B, they are designed to come together and fit in a complimentary manner in the corners of the innerspring assembly 30B, as illustrated in FIG. 5C. Further, the end L-shaped side-support members 44C and side L-shaped side-support members 44D in this embodiment have longitudinal extruded channels 70 on an external surface of the end and side L-shaped side-support members 44C, 44D to provide additional spring-like support when a load is placed on the end and side L-shaped side-support members 44C, 44D. One or more longitudinal extruded channels 70 can be provided having any depth or diameter desired to produce the desired spring-like support. All other features discussed previously with respect to the L-shaped side-support members may be applied or included in the end L-shaped side-support members 44C and side L-shaped side-support members 44D and thus will not be discussed again.

Figure 6A:
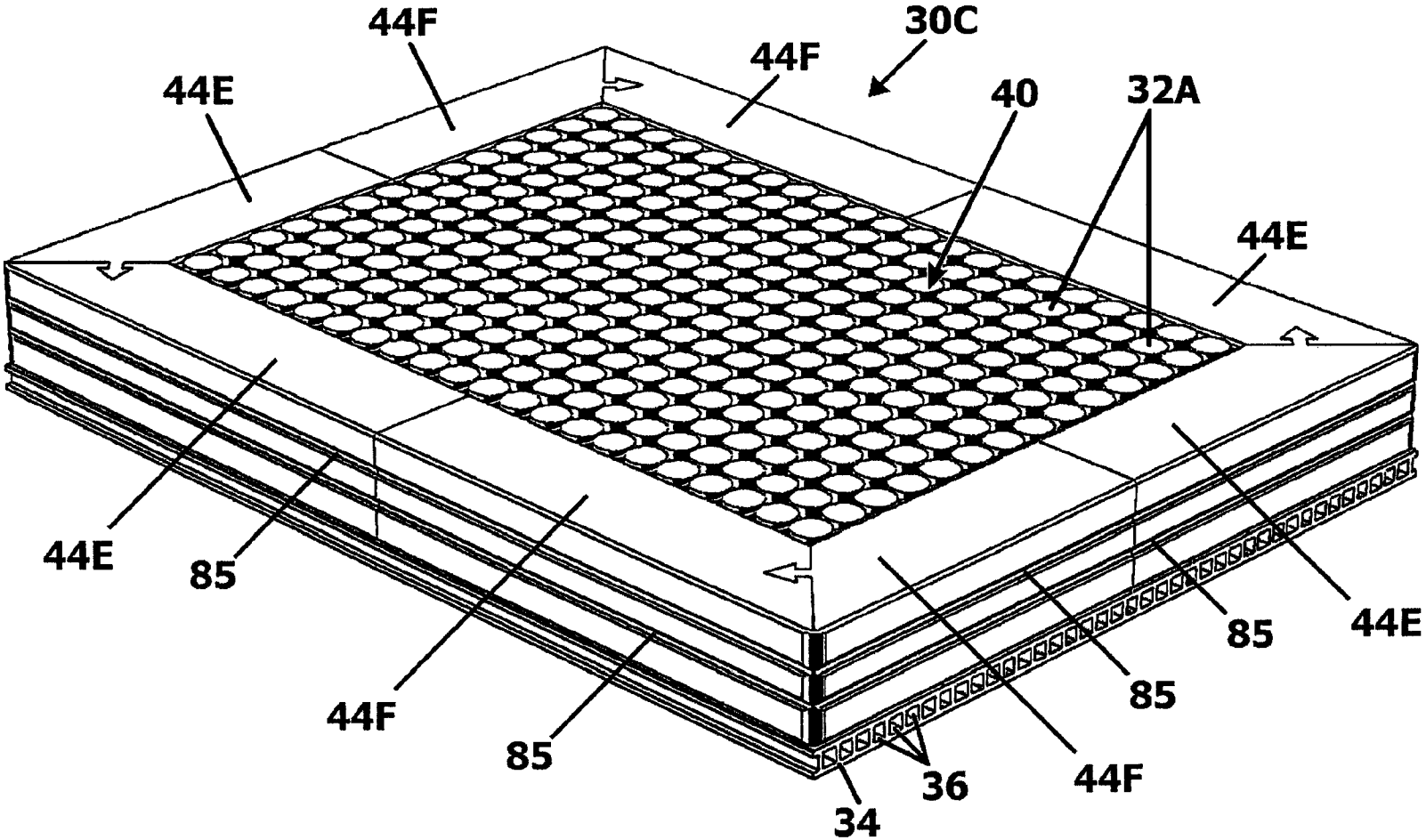
FIGS. 6A-6D are perspective views of another stepped-edge innerspring assembly with interlocking L-shaped side-support members installed on the perimeter of the innerspring assembly, according to another embodiment.
Figure 6B:
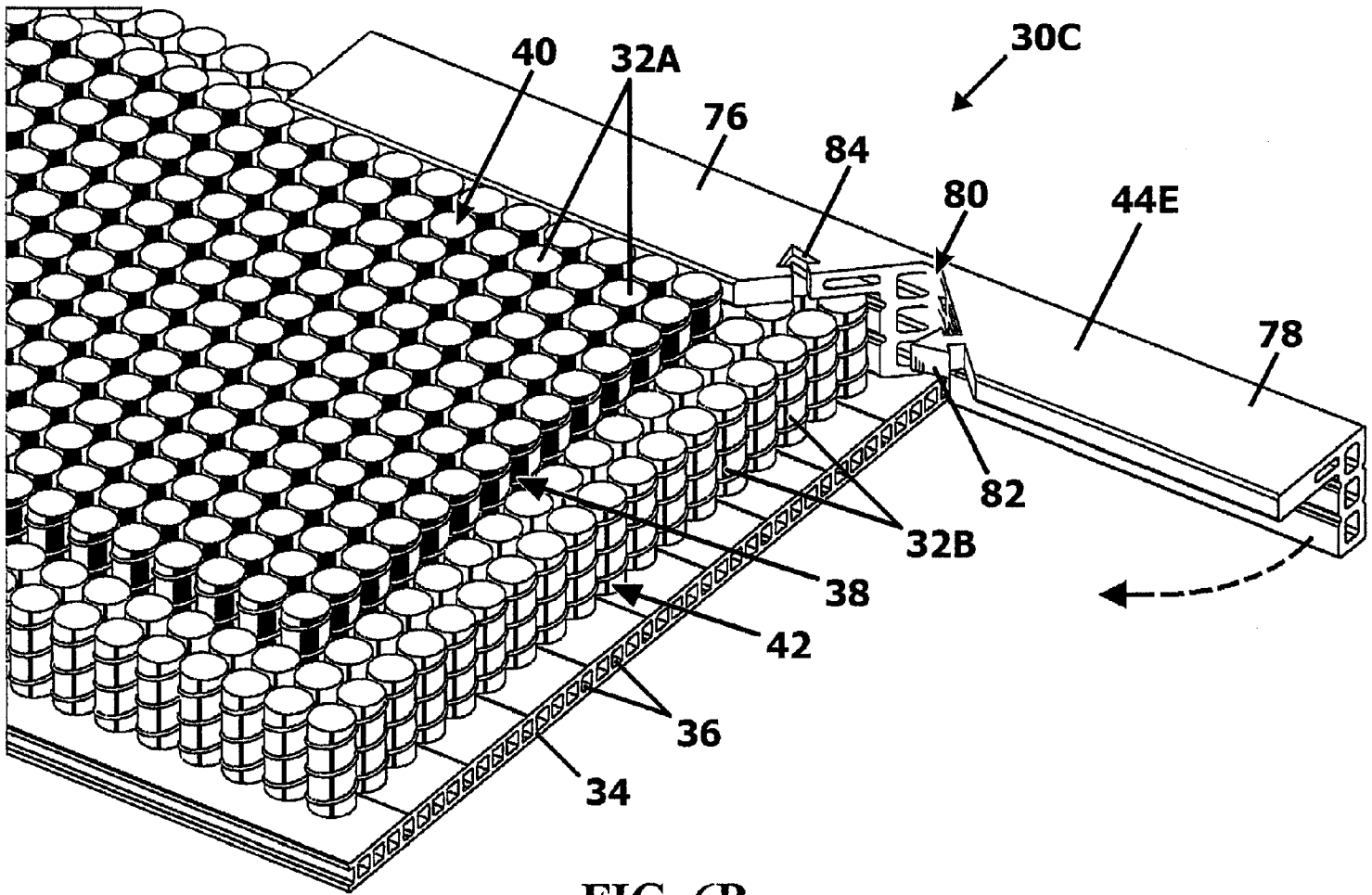
Figure 6C:
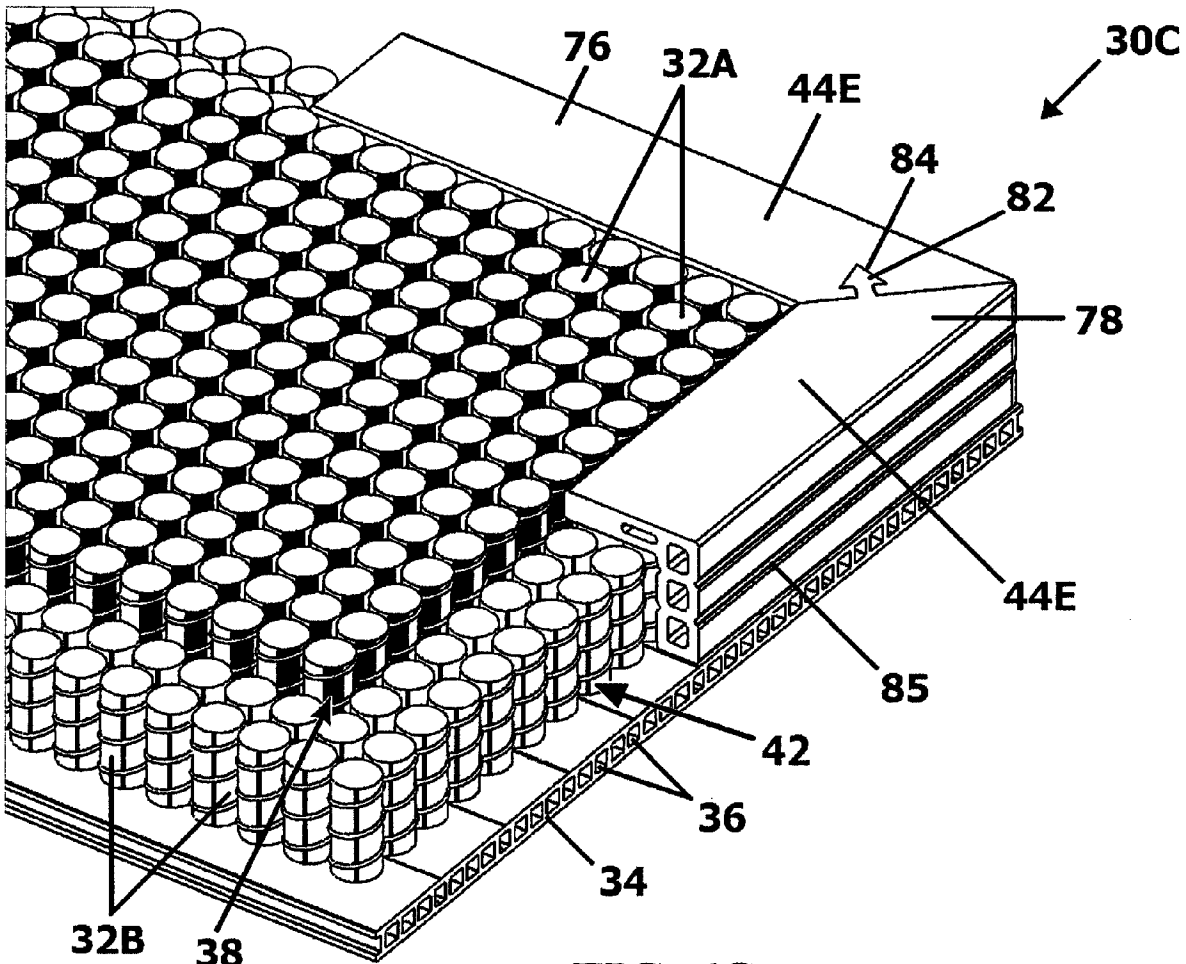
Figure 6D:
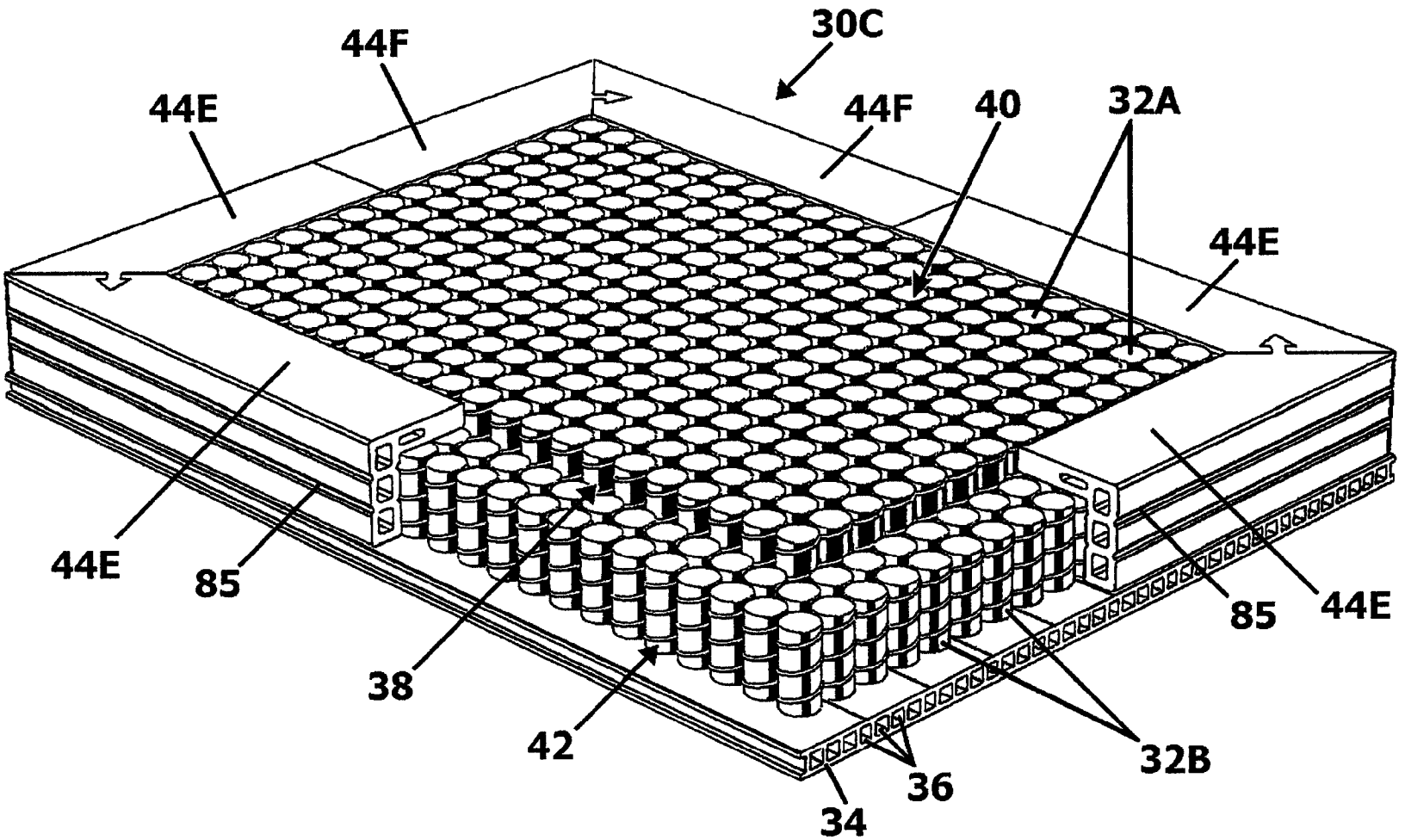

FIGS. 6A through 6D are perspective views of another alternative innerspring assembly 30C that also provides L-shaped side-support members 44E and 44F. FIG. 6A shows the fully assembled innerspring 30C. As illustrated in FIG. 6B, the innerspring assembly 30C comprises one or more L-shaped side-support members 44E comprised of elongated extruded polymer foam comprised of a first section 76 and a second section 78. A notch 80 is disposed approximately at a mid-portion of the L-shaped side-support member 44E between the first section 76 and the second section 78. The notch 80 may be cut out using a wire saw as an example. The cut is designed to leave a male member 82 in the notch 80 disposed in the second section 78 and a female member 84 disposed generally opposite the male member 82 in the first section 76. Thus, as illustrated in FIG. 6C, when the first section 76 or second section 78 is bent inward approximately ninety degrees)(90°) with respect to the other section 76, 78, the male member 82 of the second section 78 will be disposed within the female member 84 in the first section 76. In this manner, separate corner side-support members are not required, as illustrated in FIG. 6A. Due to the geometry of the perimeter area 42, two (2) unique L-shaped side-support members for a total of four (4) L-shaped side-support members according to this design are required to cover the entire perimeter area 42 of the stepped-edge 38 of the innerspring assembly 30C. L-shaped side-support member 44F illustrated in FIG. 6D provides side-support for adjacent sides of the perimeter area 42 of the innerspring assembly 30C. L-shaped side-support member 44E is disposed around the perimeter area 42 of the innerspring assembly 30C on the stepped-edge 38 adjacent to the L-shaped side-support member 44F, wherein the L-shaped side-support members 44F are disposed diagonally opposite each other. As illustrated previously and discussed above with respect to FIGS. 5A through 5C, each L-shaped side-support member 44E, 44F may include one or more longitudinal extrusion channels 85 within the exterior section of the L-shaped side-support members 44E, 44F to provide further spring action when a load is placed on the L-shaped side-support members 44E, 44F of the innerspring assembly 30C. All other features discussed previously with respect to the L-shaped side-support members may be applied or included in the L-shaped side-support members 44E, 44F and thus will not be discussed again.

FIGS. 7A through 7D are perspective views of yet another alternative innerspring assembly 30D that again provides a stepped-edge 38 disposed within the innerspring assembly 30D. The innerspring assembly 30D is comprised of interior pocketed coils 32A disposed in an interior area 40 surrounded by perimeter pocketed coils 32B disposed in a perimeter area 42 of the innerspring assembly 30D similar to innerspring assemblies 30-30C previously described. L-shaped side-support members are again disposed around the perimeter area 42 of the innerspring assembly 30D, but with a different configuration than previously described. In this embodiment, the L-shaped side-support members are comprised of elongated L-shaped side-support members 44G disposed around the perimeter area 42 of the innerspring assembly 30D with separate L-shaped side-support corner members 44H, 44I disposed on the corners of the stepped-edge 38 in the innerspring assembly 30D. Instead of providing asymmetrical L-shaped side-support corner members 44H, 44I, symmetrical L-shaped side-support corner members, either exclusively 44H or 44I, could be employed. Also note that the L-shaped side-support members 44G may be of differing lengths.

Figure 7A:
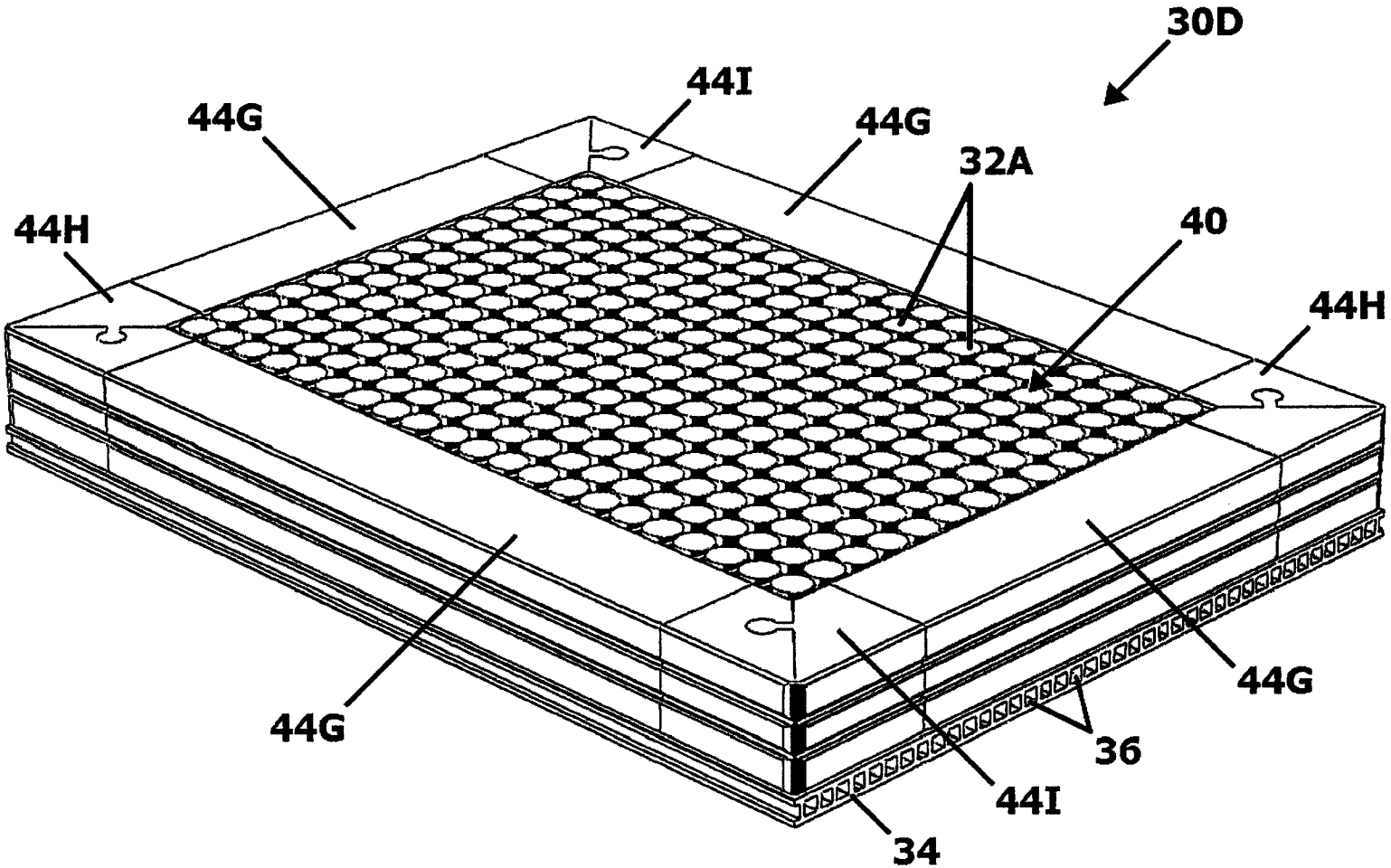
FIGS. 7A-7D are perspective views of another stepped-edge innerspring assembly with alternate interlocking L-shaped side-support members installed on the perimeter of the innerspring assembly, according to another embodiment.
Figure 7B:
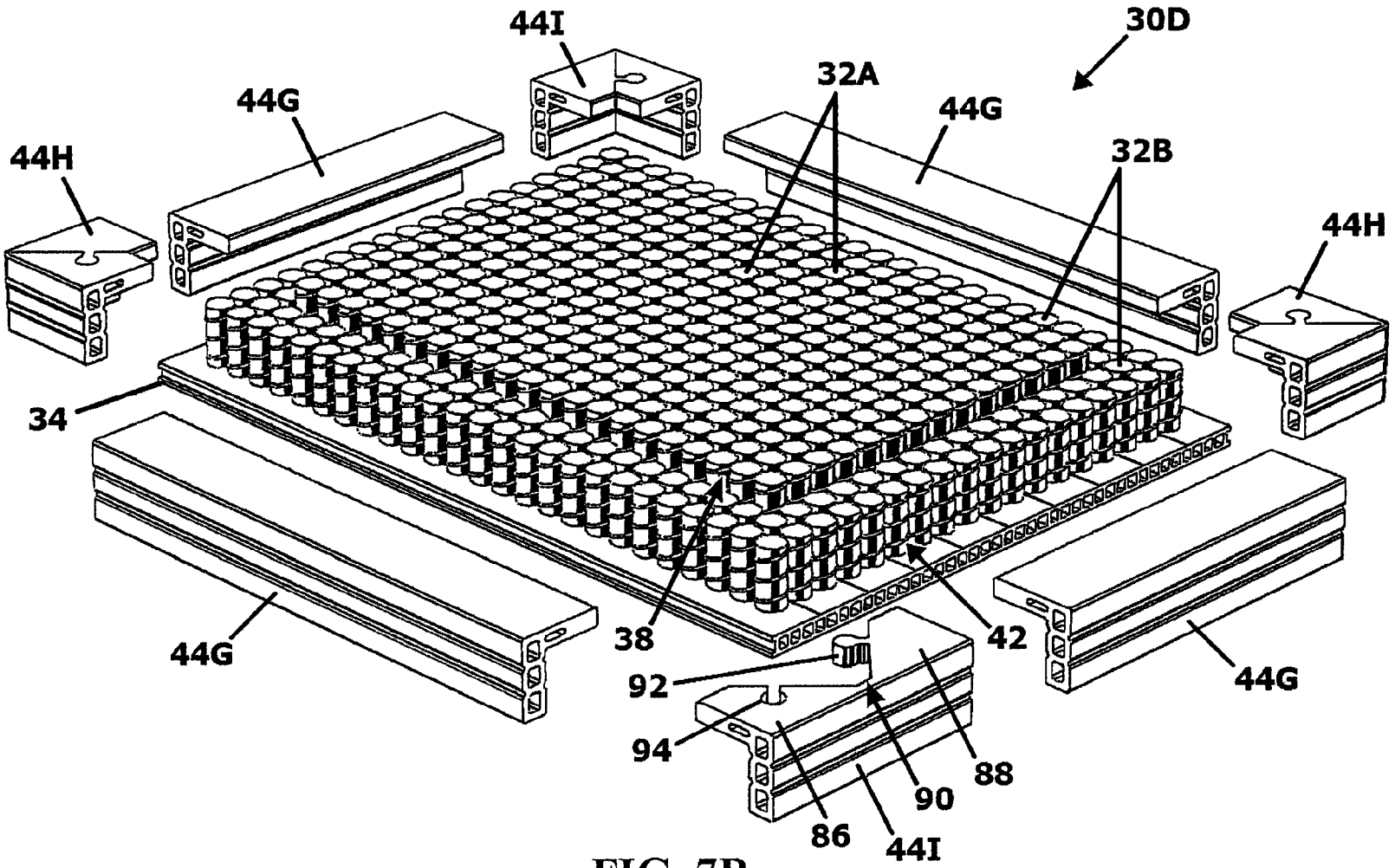
Figure 7C:
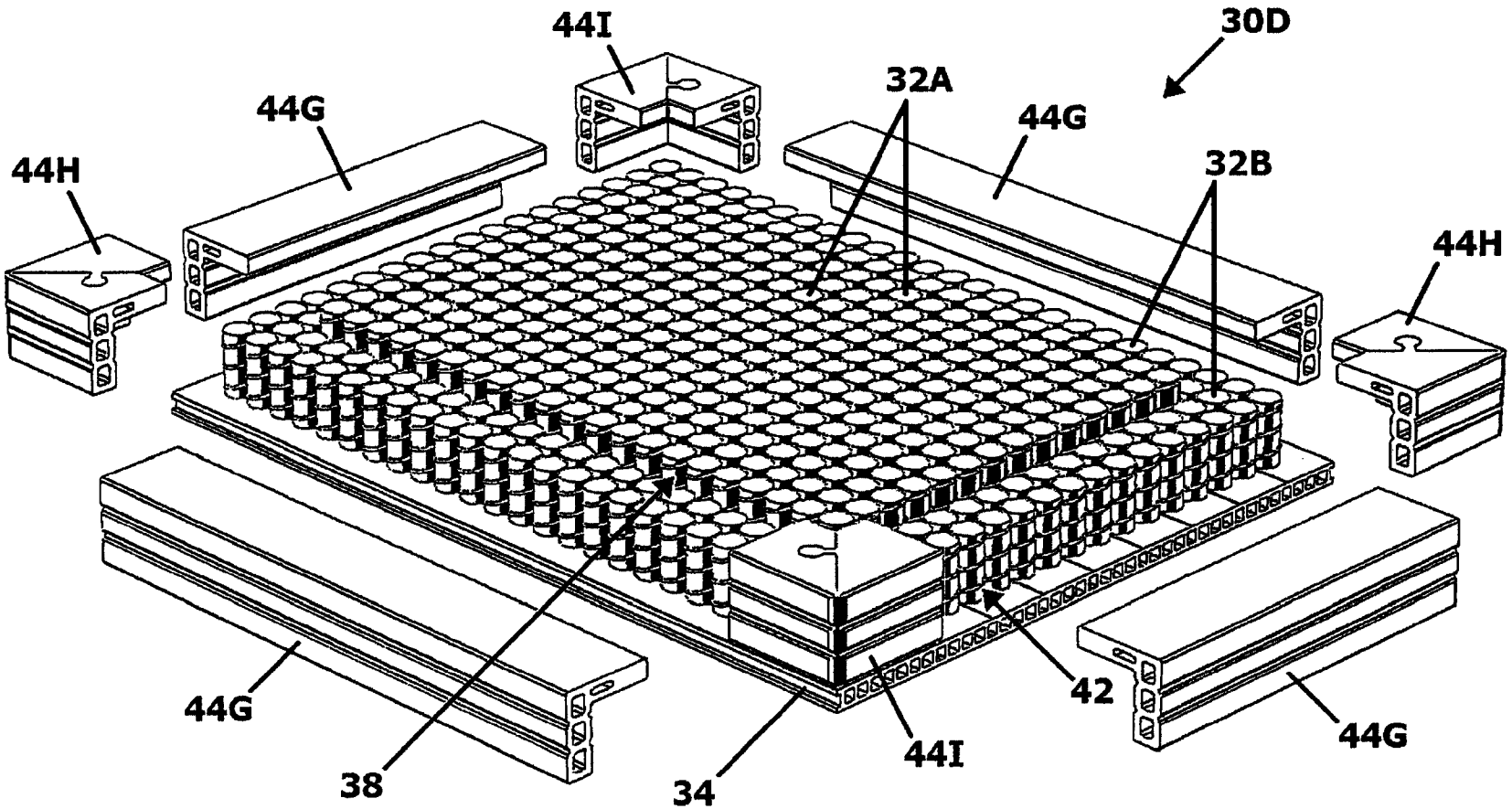
Figure 7D:
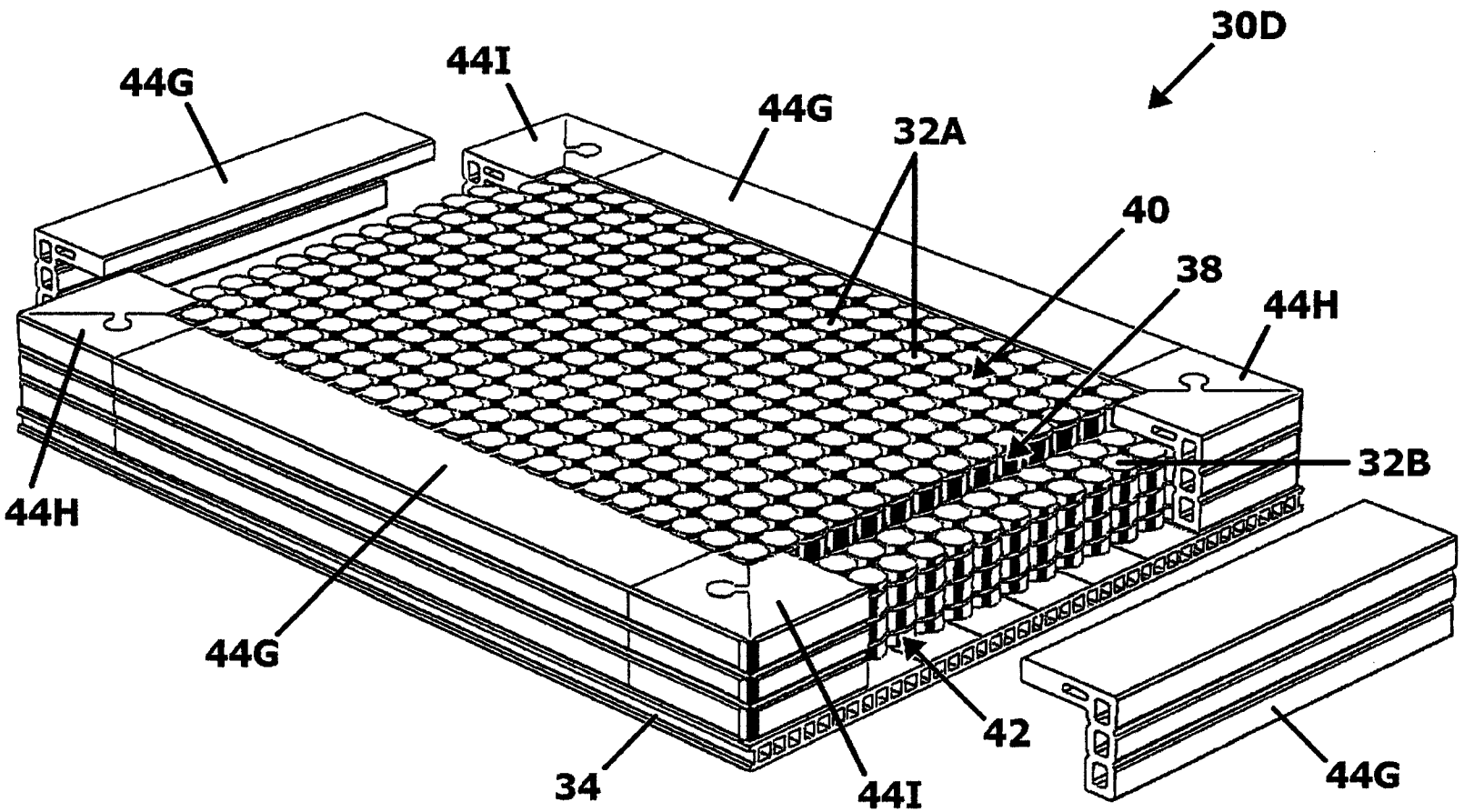

FIG. 7B illustrates an exploded view of the L-shaped side-support corner members 44H, 44I before being installed in the innerspring assembly 30D. As illustrated therein, each L-shaped side-support corner member 44H, 44I is comprised of an elongated section comprised of a first section 86 and a second section 88. A notch 90 is cut between the first section 86 and the second section 88; however, a male member 92 and a female member 94 are left in the cut or extruded L-shaped side-support corner members 44H, 44I. In this manner, the L-shaped side-support corner members 44H, 44I can be folded wherein either the first section 86 or the second section 88 is folded onto the other section 86, 88 such that the male member 92 is engaged with the female member 94 to provide a completed L-shaped side-support corner member 44H, 44I as illustrated in FIG. 7B. In this manner, the L-shaped side-support corner members 44H, 44I can be disposed on the corner areas of the innerspring assembly 30D on the stepped-edge 38 to provide side-support or edge-support in the corners of the innerspring assembly 30D as illustrated in FIG. 7C. An installation process may comprise installing an L-shaped side-support corner member 44H, 44I followed by an elongated L-shaped side-support members 44G, as illustrated in FIG. 7C, around the perimeter area 42 of the innerspring assembly 30D as illustrated in FIG. 7D until completed side-supports are installed around the entire perimeter area 42 of the innerspring assembly 30D as illustrated in FIG. 7A. All other features discussed previously with respect to the L-shaped side-support members may be applied or included in the L-shaped side-support members 44G-44I and thus will not be discussed again.

Figure 8A:
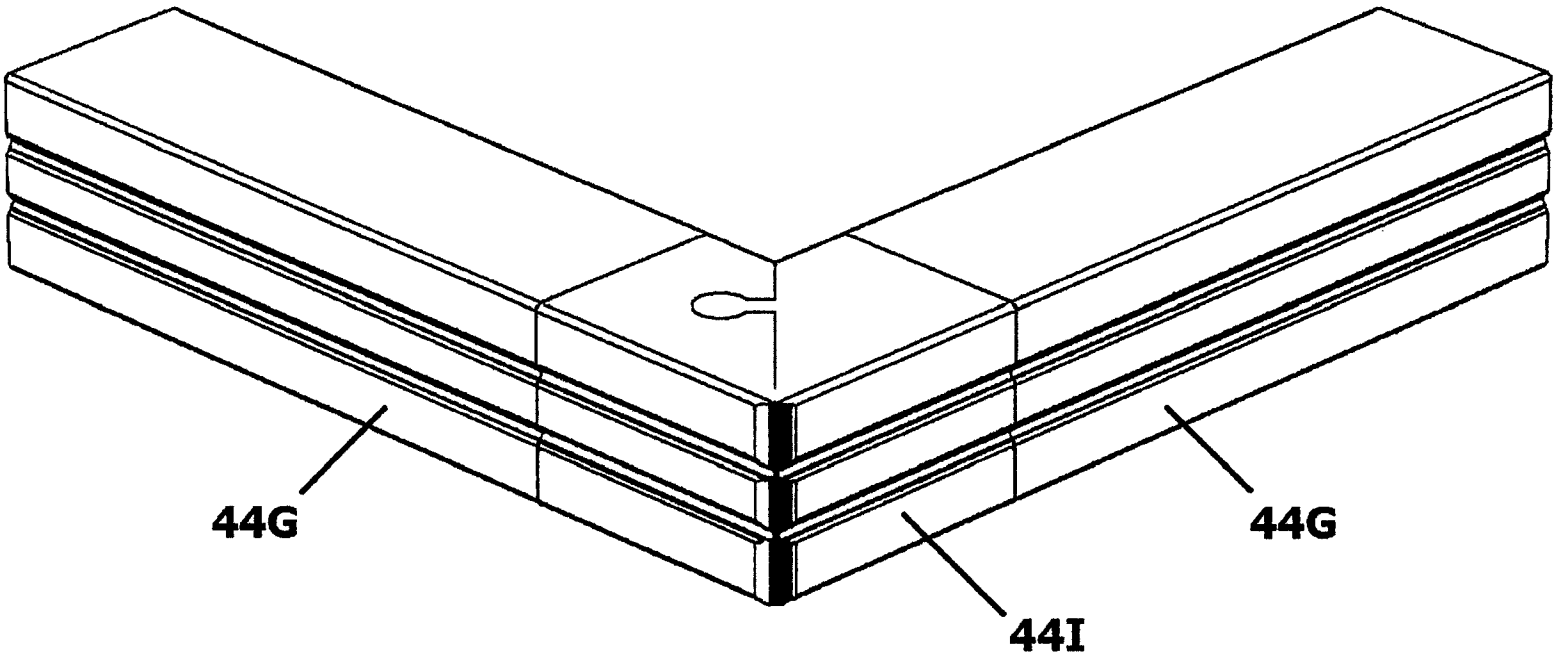
FIGS. 8A-8D are perspective views of the interlocking L-shaped side-support members of FIGS. 7A-7D with dowels or pegs installed between adjacent side-support members for additional support, according to another embodiment.
Figure 8B:
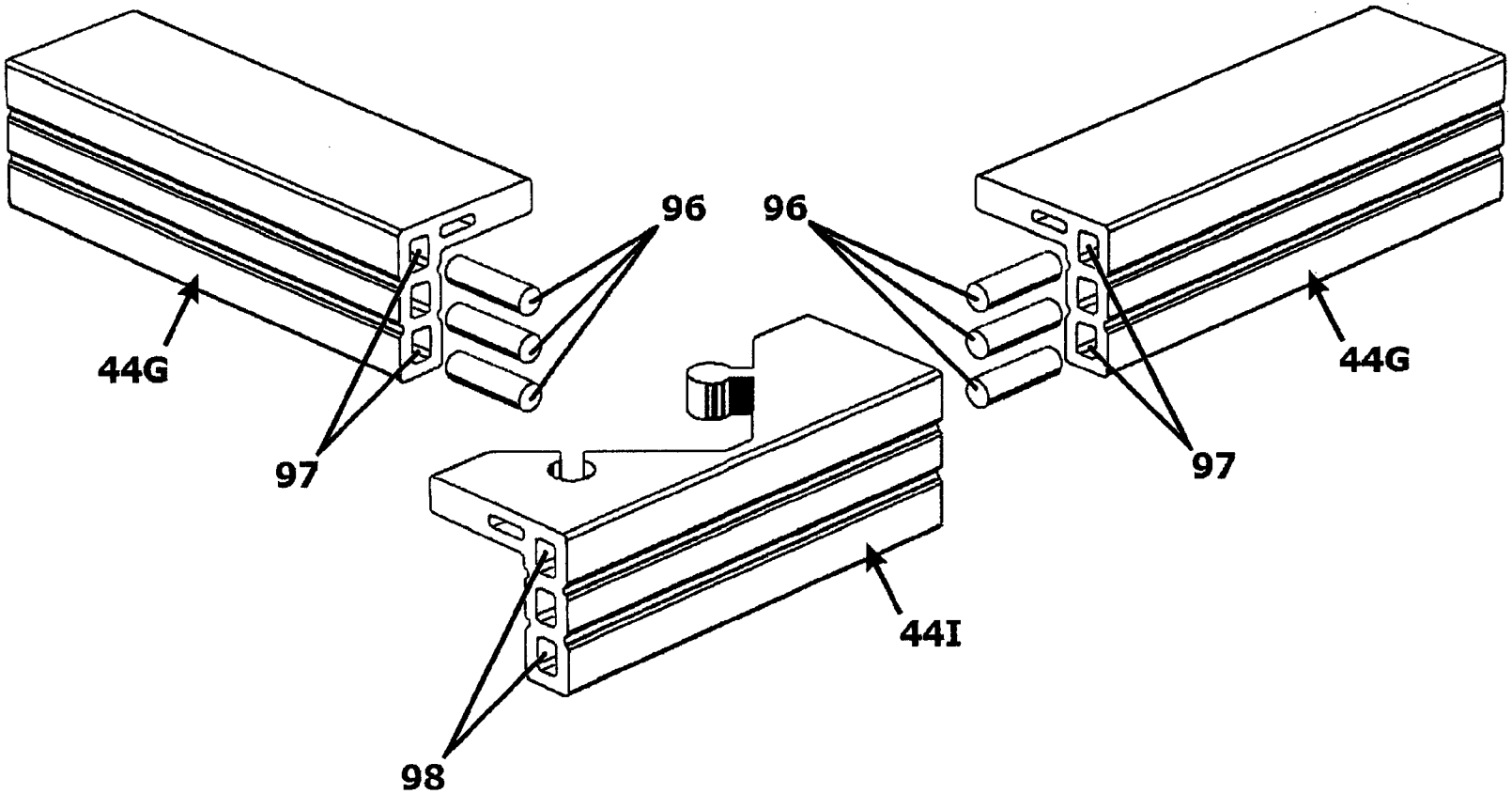
Figure 8C:
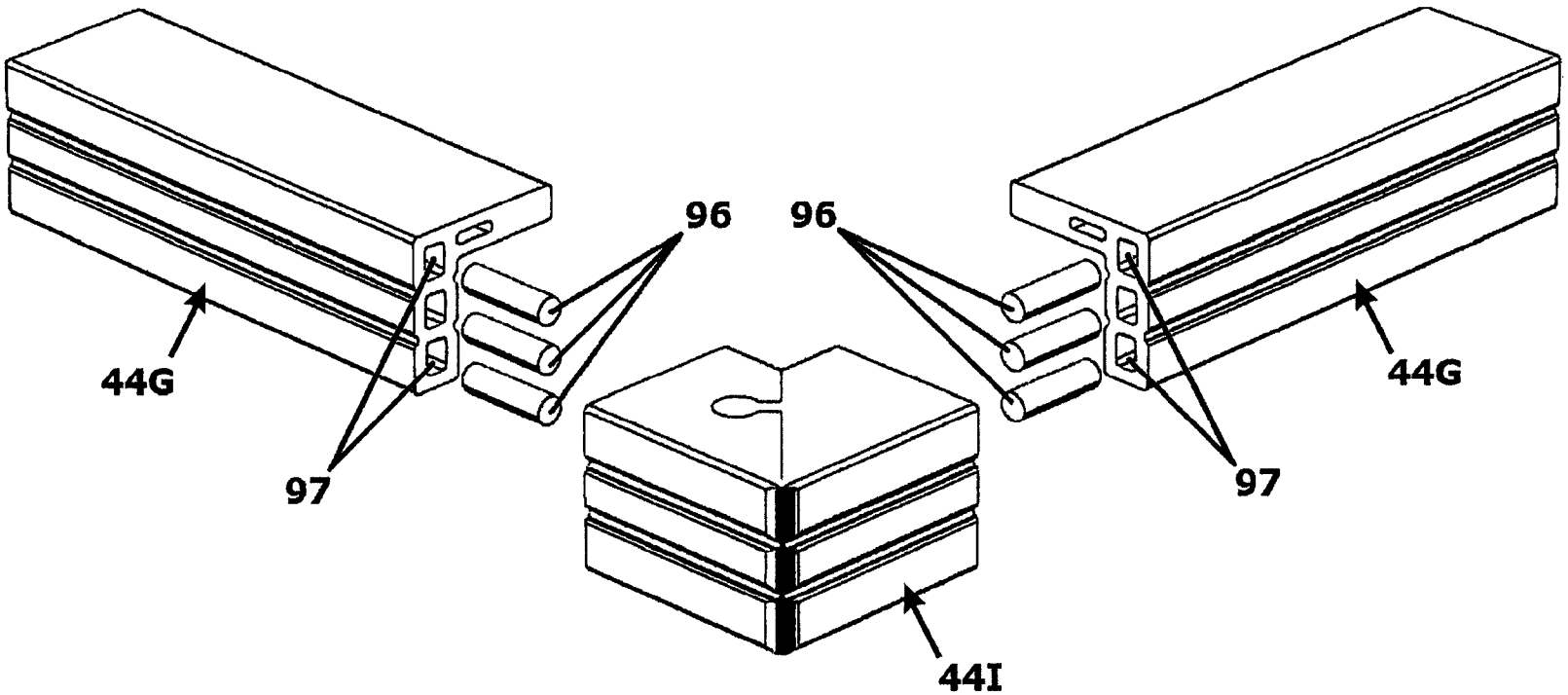
Figure 8D:
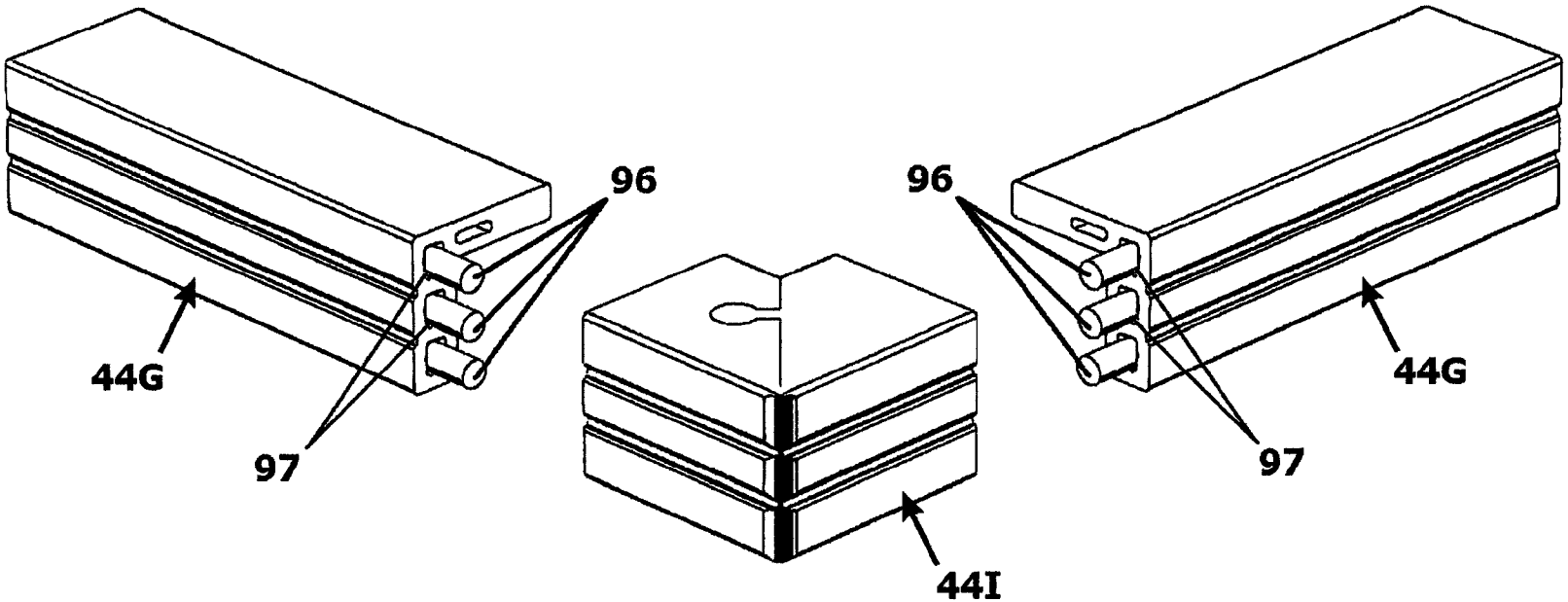

FIGS. 8A through 8D illustrate perspective views of the interlocking L-shaped side-support members 44G, 44H, and 44I of FIGS. 7A-7D, but with dowels or pegs installed therebetween for additional support, according to another embodiment. FIG. 8A illustrates the L-shaped side-support corner member 44I provided in FIGS. 7A-7D attached to two adjacent elongated L-shaped side-support members 44G. However, as illustrated in FIGS. 8B-8D, one or more dowels or pegs 96 are disposed in longitudinal extruded channels 97, 98 disposed in the elongated L-shaped side-support members 44G and the L-shaped side-support corner member 44I, respectively. In this manner, the dowels 96 provide additional connection support between the elongated L-shaped side-support members 44G and the L-shaped side-support corner member 44I when a load is placed on the elongated L-shaped side-support members 44G and the L-shaped side-support corner member 44I. The dowels 96 may be comprised of any material, including but not limited to polymer foam, including the examples previously referenced. The dowels 96 may be adhesively attached inside the longitudinal extruded channels 97, 98, or simply placed within the longitudinal extruded channels 97, 98 without use of an adhesive. Either way, the dowels 96 will be locked and retained in the longitudinal extruded channels 97, 98 when the elongated L-shaped side-support members 44G and the L-shaped side-support corner member 44I are secured to each other and disposed on the stepped-edge 38 of an innerspring assembly. All other features discussed previously with respect to the L-shaped side-support members may be applied or included in the L-shaped side-support members 44G-44I and thus will not be discussed again.

Figure 9A:
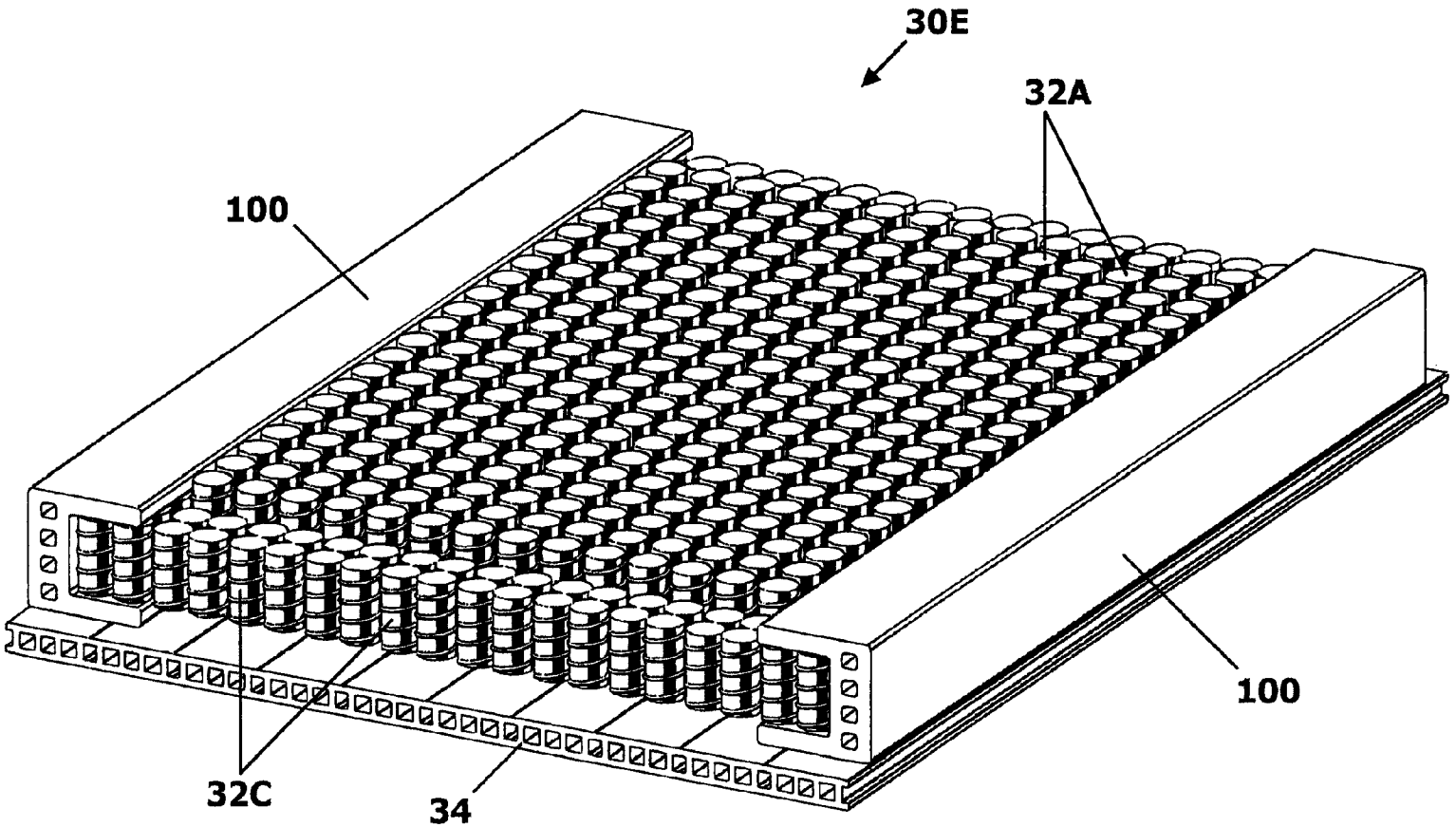
FIG. 9A is another stepped-edge innerspring assembly with C-shaped side-support members installed on the perimeter of the innerspring assembly, according to another embodiment.
Figure 9B:
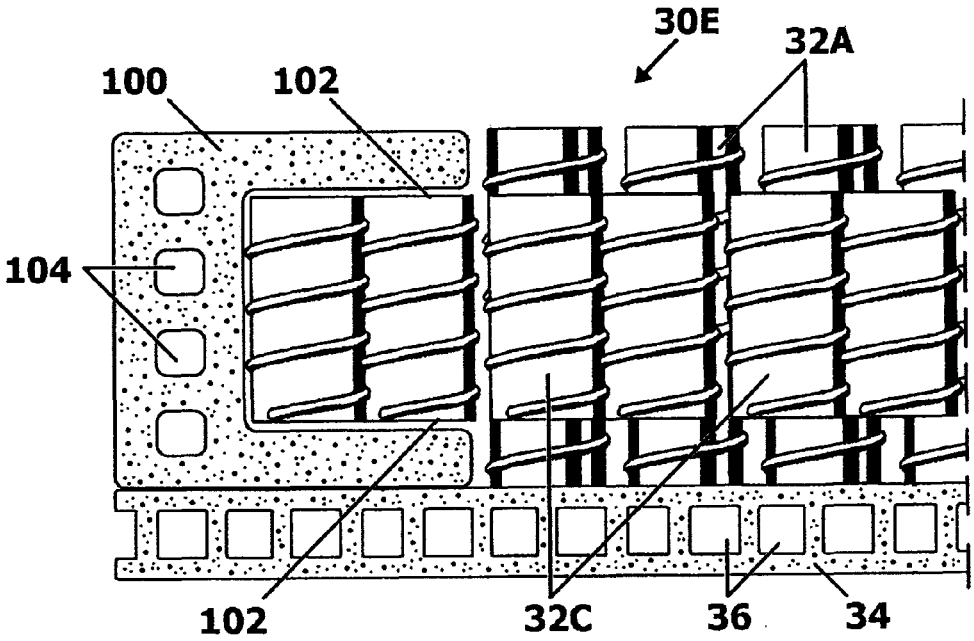
FIG. 9B is a partial side view of the stepped-edge innerspring assembly and side-support member of FIG. 9A.
Figure 9C:
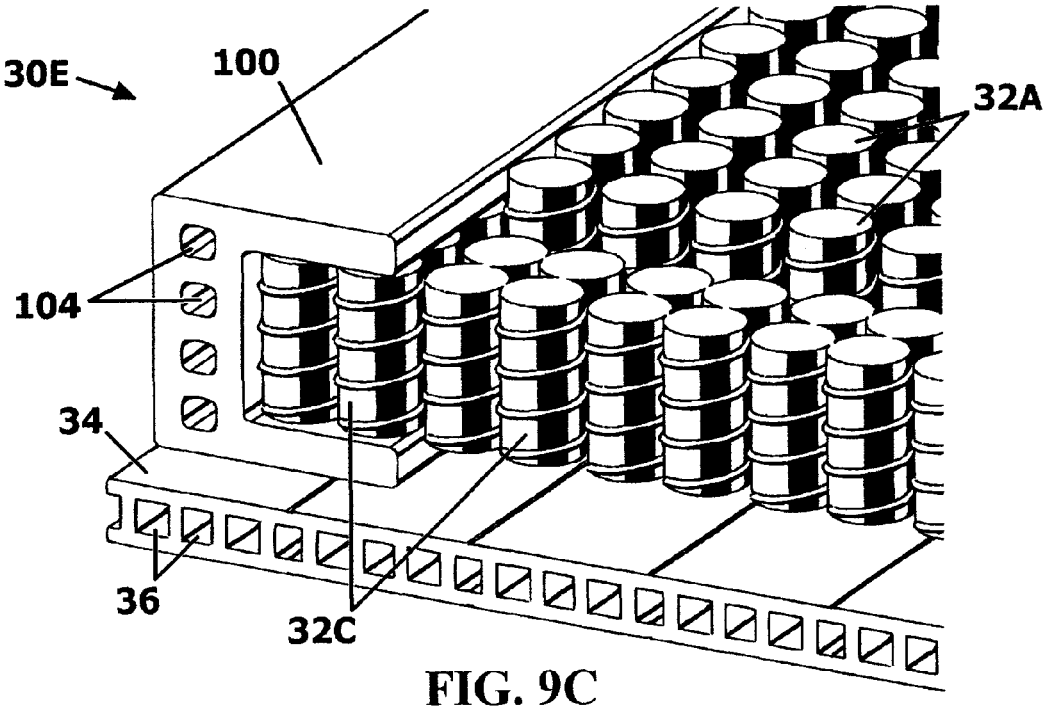
FIG. 9C is a close-up view of the stepped-edge innerspring assembly and side-support member of FIG. 9A.

FIGS. 9A-9C illustrate another innerspring assembly 30E employing C-shaped side-support members 100 instead of L-shaped side-support members. FIG. 9B is a partial side view of the stepped-edge innerspring assembly 30E and C-shaped side-support members 100. FIG. 9C is a close-up view of the stepped-edge innerspring assembly 30E and C-shaped side-support members 100. C-shaped side-support members 100 are designed to be disposed around both ends 102 of shorter, perimeter pocketed coils 32C as opposed to only one end as provided by the previously described L-shaped side-support members. In this manner, the perimeter pocketed coils 32C are not attached to the base 34. The remaining components of the innerspring assembly 30E may be the same as previously described for the innerspring assemblies 30-30D. Providing C-shaped side-support members 100 may provide firmer support in the perimeter area 42 than an L-shaped side-support member. Further, the C-shaped side-support members 100 may be pre-constructed as composites, which include shorter perimeter pocketed coils 32C so as to create a more efficient manufacturing method whereby assembly is simplified by the addition of said composite. Again, longitudinal extruded channels 104 may be extruded from the C-shaped side-support members 100 to provide a further spring-like effect. All other features discussed previously with respect to the L-shaped side-support members 44 and the innerspring assembly 30 in FIGS. 2A-2C as well as the other embodiments described above may be applied or included in the C-shaped side-support members 100 and innerspring assembly 30E and thus will not be discussed again.

Figure 10A:
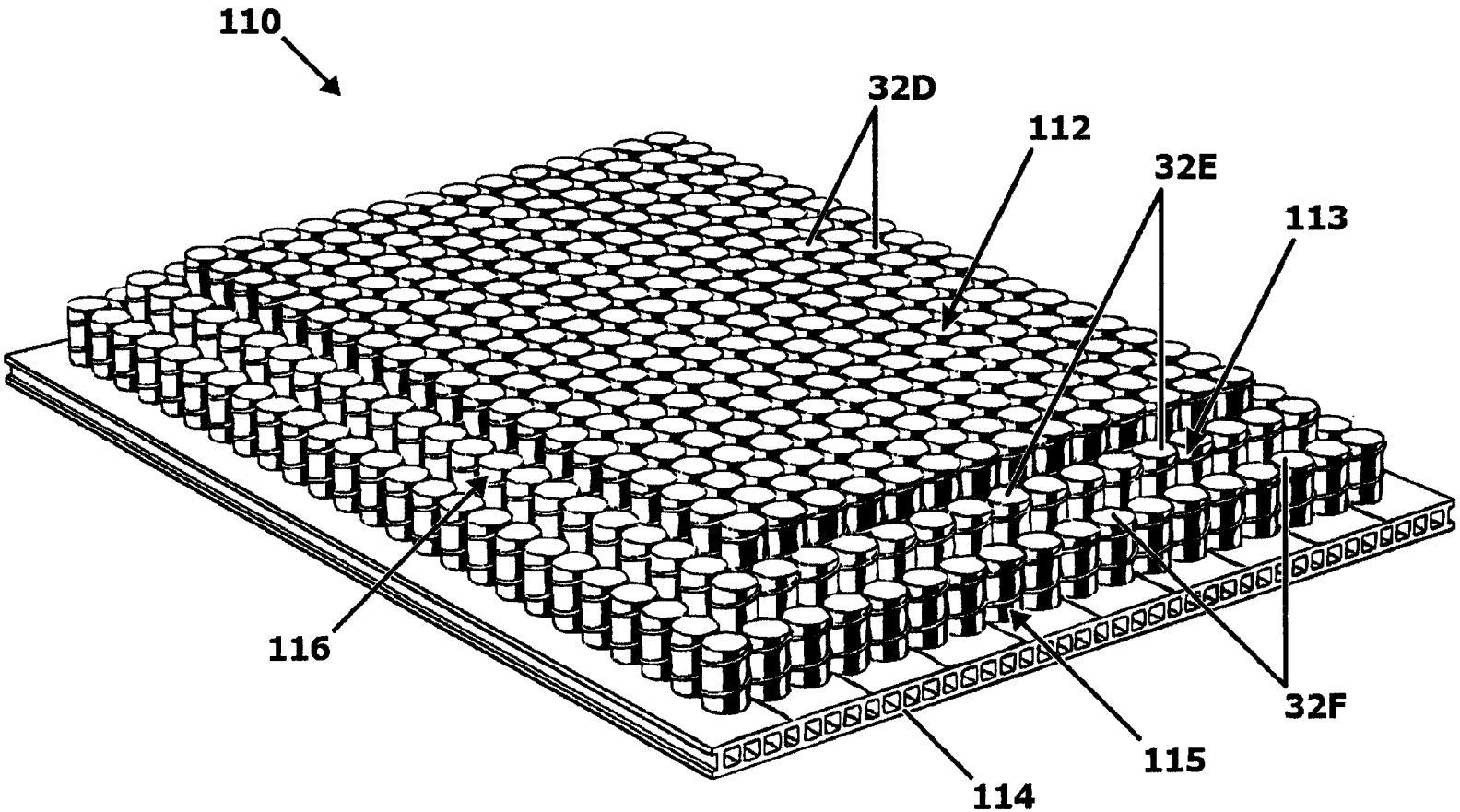
FIG. 10A illustrates another exemplary stair stepped-edge innerspring assembly, according to another embodiment.

FIGS. 10A-10H illustrate another embodiment of an exemplary stair stepped-edge innerspring assembly 110 that may be provided in lieu of a stepped-edge innerspring assembly in another embodiment. In this embodiment, as illustrated in FIG. 10A, three levels or areas of pocketed coils 32 are provided. Interior pocketed coils 32D are provided in an interior area 112 of the innerspring assembly 110. Intermediate pocketed coils 32E are disposed adjacent the interior pocketed coils 32D in an intermediate area 113, followed by perimeter pocketed coils 32F in a perimeter area 115 disposed adjacent the intermediate pocketed coils 32E. Each of the arrays of pocketed coils 32D-32F are disposed on and attached to a base 114. The base 114 may be the same base 34 as previously described, and the pocketed coils 32D-32F may be attached to the base 114 in the same manner as the pocketed coils 32A-32C are attached to the base 34. The interior pocketed coils 32D are the tallest pocketed coils in the innerspring assembly 110. The perimeter pocketed coils 32F are the shortest pocketed coils in the innerspring assembly 110. The intermediate pocketed coils 32E are of a height between the height of the interior pocketed coils 32D and the perimeter pocketed coils 32F. In this manner, a stair stepped-edge 116 is provided around the perimeter of the innerspring assembly 110 as opposed to a stepped-edge 38 previously described. The stair stepped-edge 116 can provide three area of firmness in the innerspring assembly 110. Further, providing intermediate area(s) in the innerspring assembly 110 may assist in further reducing the amount of spring material to reduce costs while providing a spring-like surface to allow side-supports to intrude further into the interior area or sleeping surface area of the innerspring assembly 110.

Figure 10B:
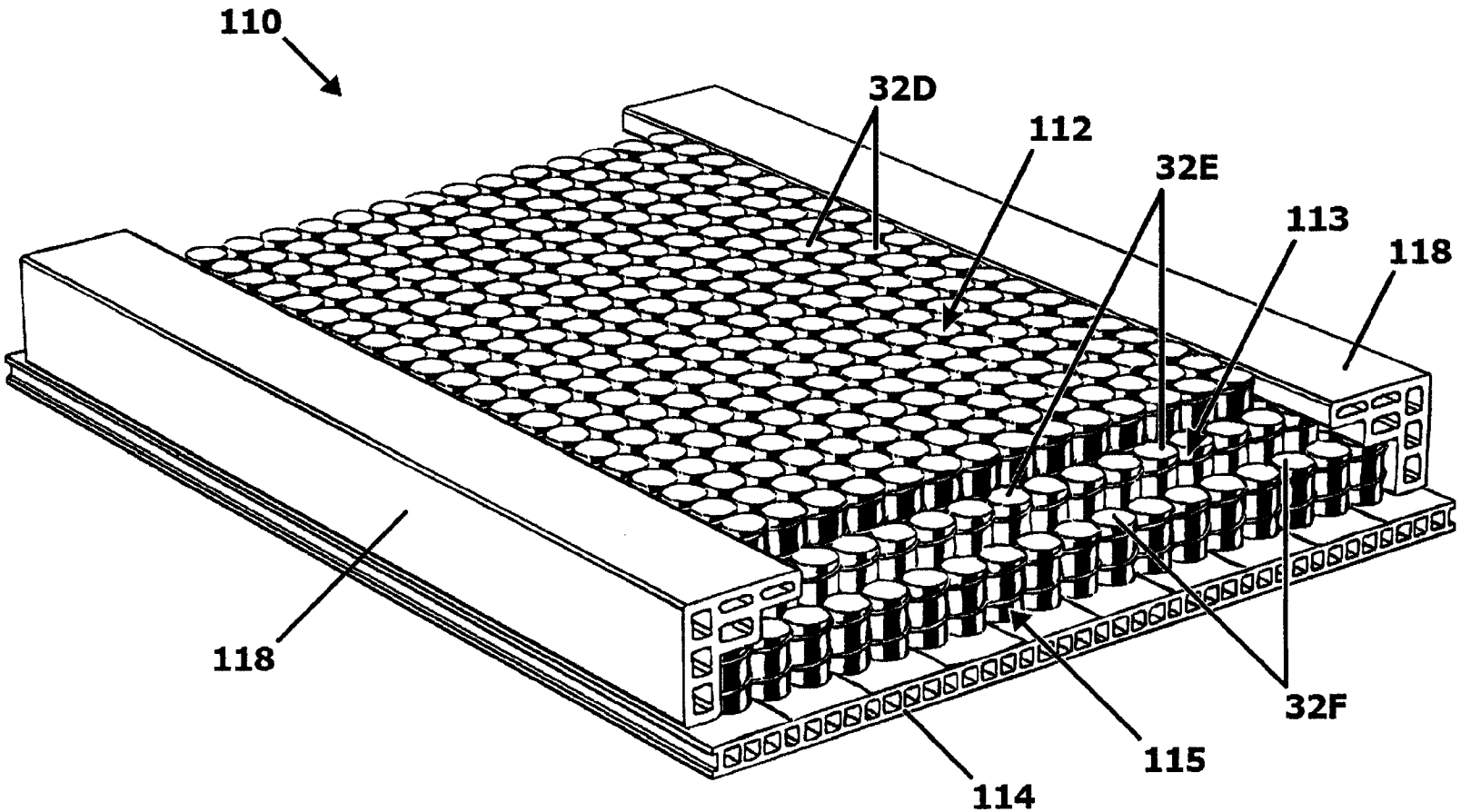
FIG. 10B is a perspective view of another stair stepped-edge innerspring assembly of FIG. 10A, with stair-stepped side-support members installed on the perimeter of the innerspring assembly.
Figure 10C:
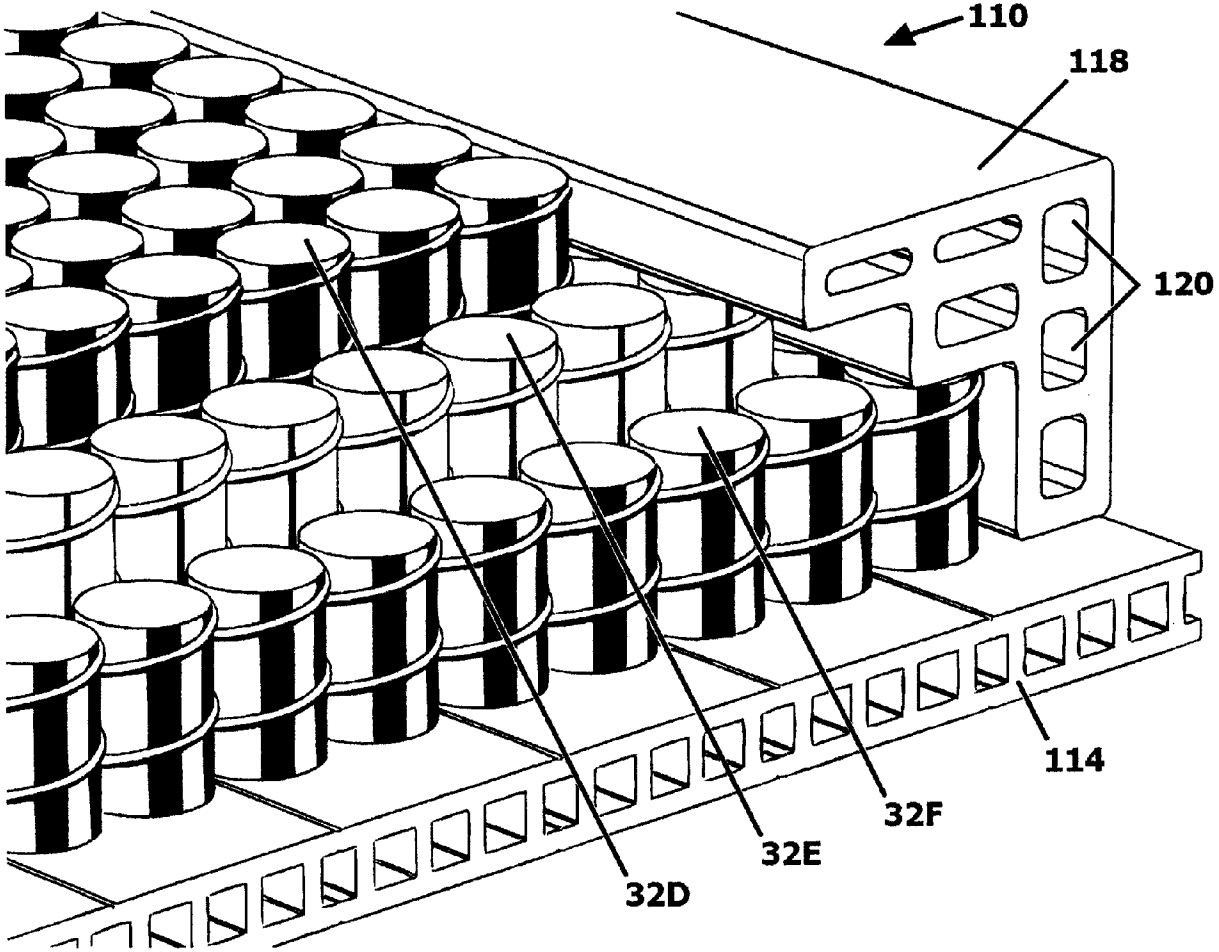
FIG. 10C is a close-up view of the stair stepped-edge innerspring assembly with stair-stepped side-support members installed on the perimeter of the innerspring assembly of FIG. 10B.
Figure 10D:
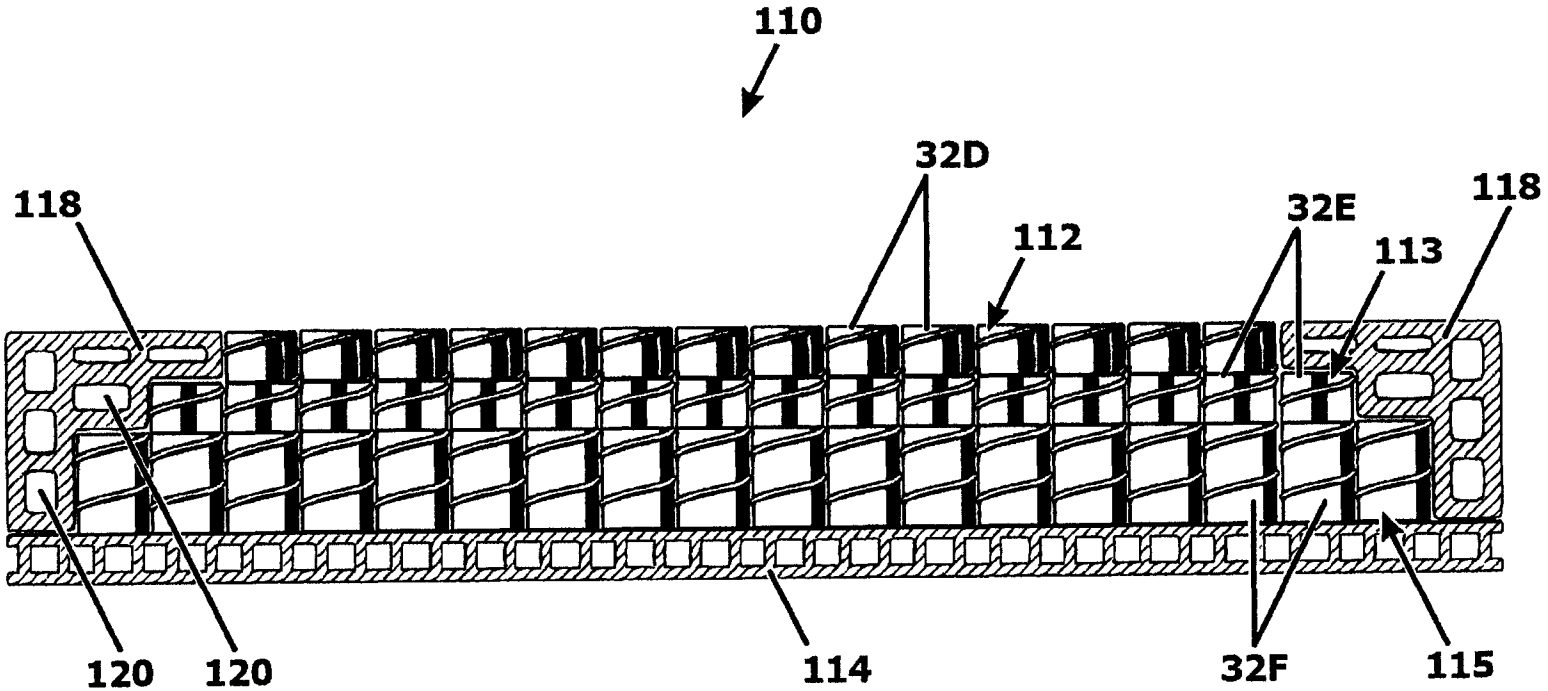
FIG. 10D is a side view of FIG. 10B.

FIG. 10B is a perspective view of another stair stepped-edge innerspring assembly 110 of FIG. 10A, with stair-stepped side-support members 118 installed around the perimeter of the innerspring assembly 110. The stair-stepped side-support members 118 are disposed on top of the intermediate pocketed coils 32E and the perimeter pocketed coils 32F. FIG. 10C is a close-up view of the stair stepped-edge innerspring assembly 110 with the stair-stepped side-support members 118 installed on the perimeter of the innerspring assembly 110 of FIG. 10A. FIG. 10D is a side view of FIG. 10B. As illustrated in FIG. 10D, the stair-stepped side-support members 118 have a profile that provides a planar or substantially planar surface to the interior area 112 of the innerspring assembly 110. One or more longitudinally extruded channels 120 may be extruded from the stair-stepped side-support members 118 to provide a spring-like support in transition areas between the interior area 112 and the edge of the innerspring assembly 110.

Figure 10F:
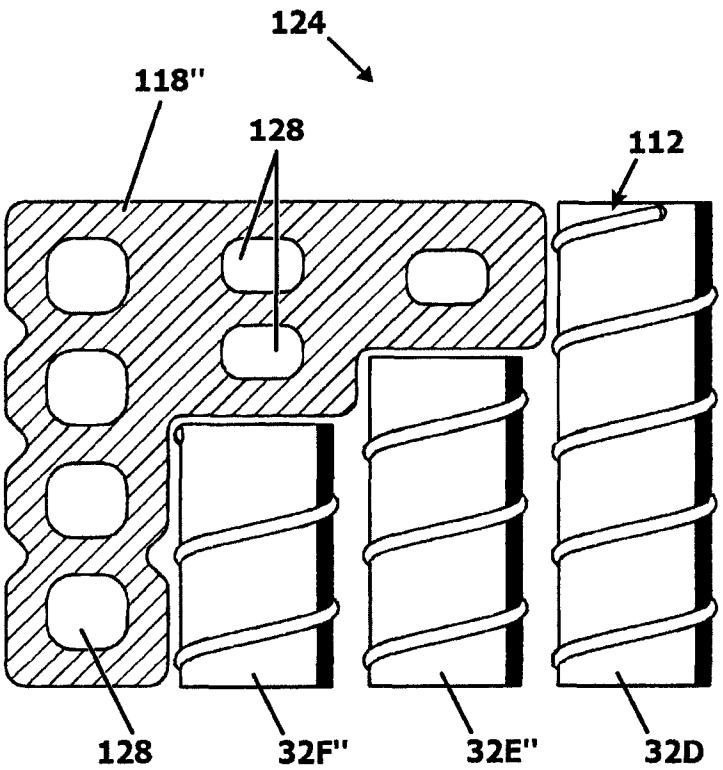
FIGS. 10E and 10F are side views of alternate stair stepped-edge innerspring assembly profiles and complimentary stair-stepped side-support members.
Figure 10E:
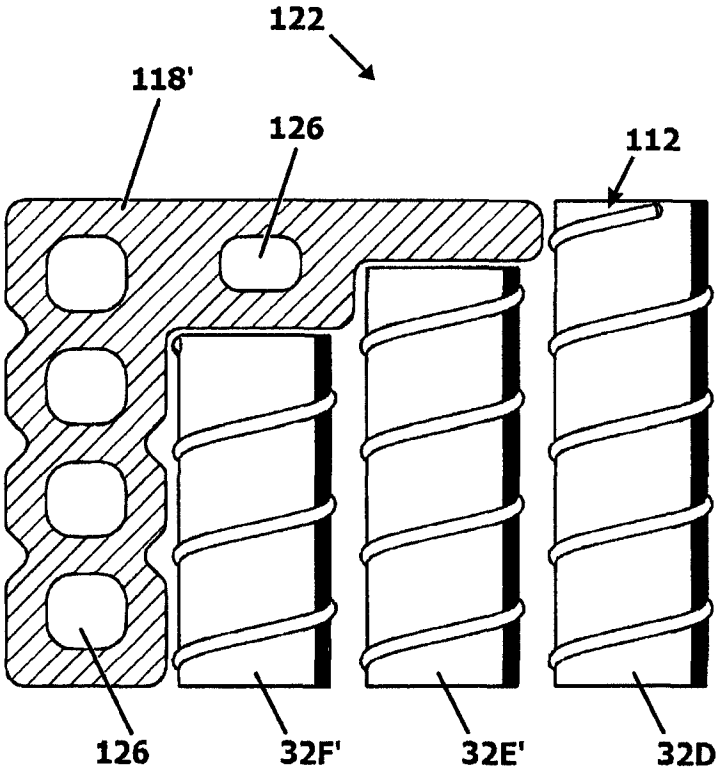

FIGS. 10E and 10F are side views of alternate stair stepped-edge innerspring assembly profiles 122, 124 and complimentary stair-stepped side-support members 118', 118". As illustrated therein, the intermediate pocketed coils 32E', 32E" and perimeter pocketed coils 32F', 32F" may be provided of varying heights. Height variations provide a different feel in the transitions areas between the interior area 112 and the edge of the innerspring assembly 110. The size and number of longitudinal extruded channels 126, 128 included in the stepped-edge innerspring assembly profiles 122, 124 may also be affected by the height of the intermediate pocketed coils 32E', 32E" and the perimeter pocketed coils 32F', 32F'.

Figure 10G:
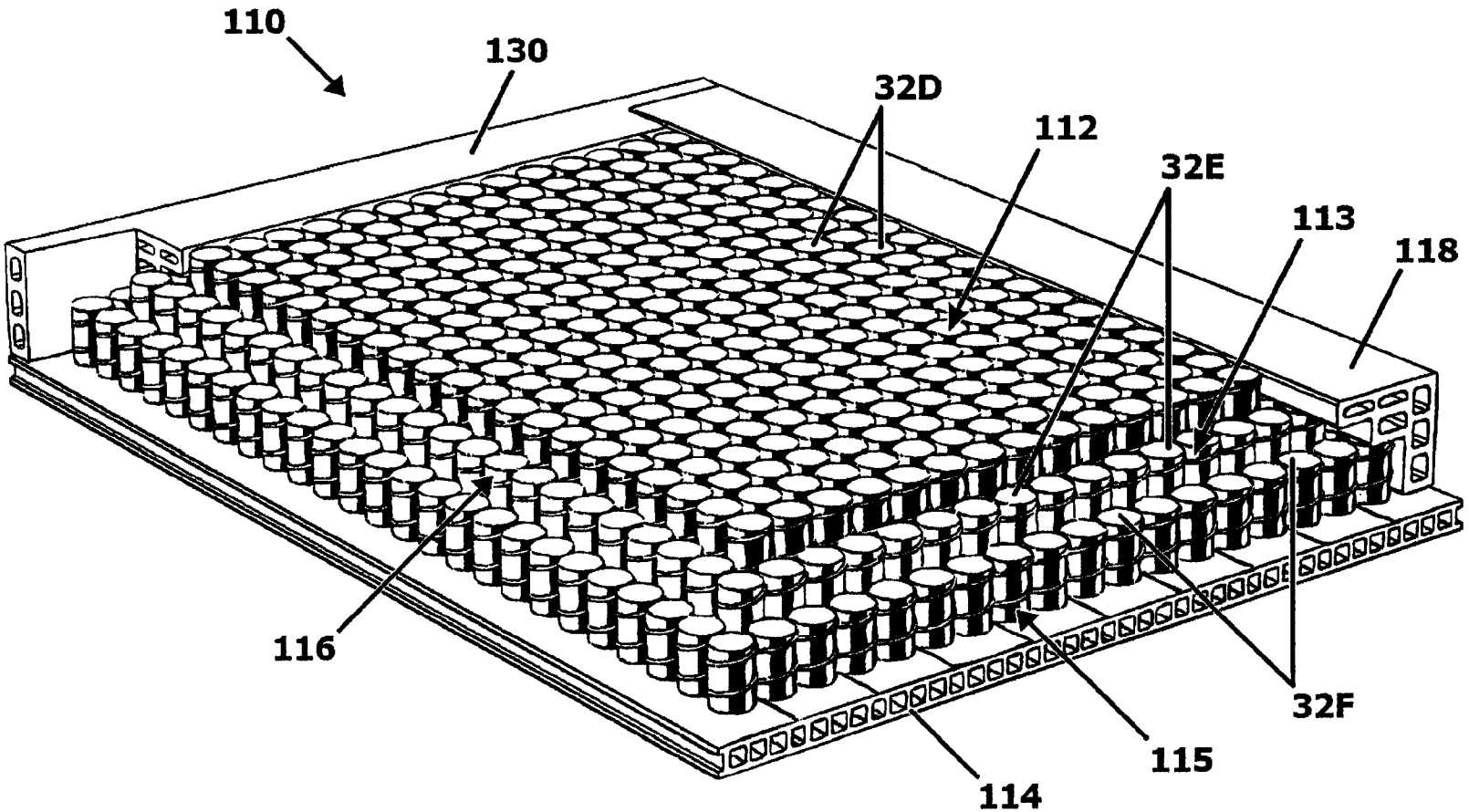
FIGS. 10G and 10H are perspective views of the stair stepped-edge innerspring assembly of FIG. 10A with two stair-stepped side-support members installed on the perimeter and abutted together in a corner of the stair stepped-edge innerspring assembly.
Figure 10H:
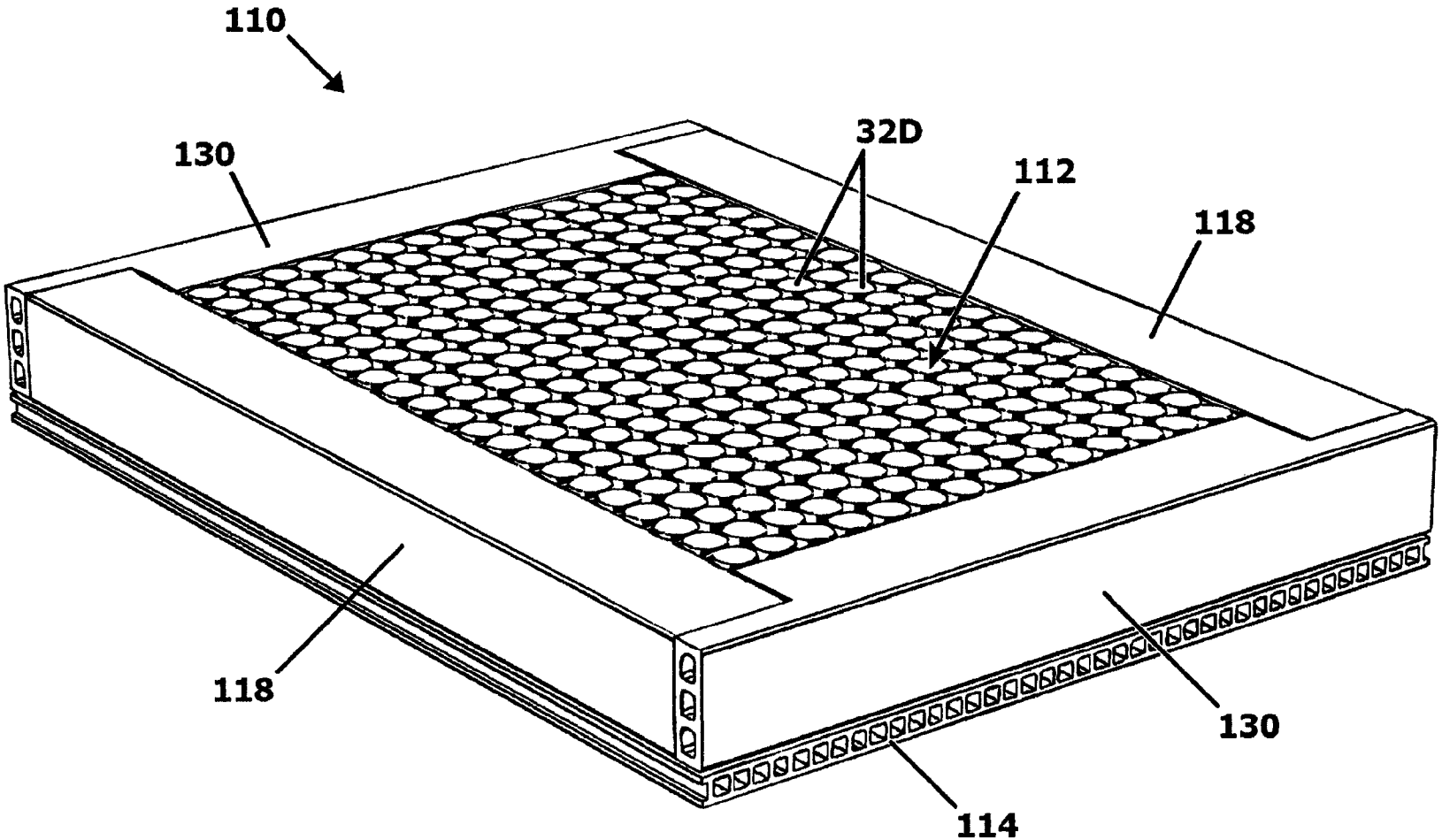

FIGS. 10G and 10H are perspective views of the stair stepped-edge innerspring assembly 110 of FIG. 10A with two stair-stepped side-support members 118, 130 installed on the perimeter and abutted together in a corner of the stair stepped-edge innerspring assembly 110. The stair-stepped side-support members 118, 130 are arranged similar to the L-shaped side-support members 44C, 44D, respectively in FIGS. 5A-5C, to provide corner fitting in the innerspring assembly 110. All other features discussed previously with respect to the stair-stepped side-support members 118, 130 and the innerspring assembly 110 may be applied to the innerspring assembly 110 and its components in FIGS. 10A-10G and thus will not be discussed again.

Figure 11A:
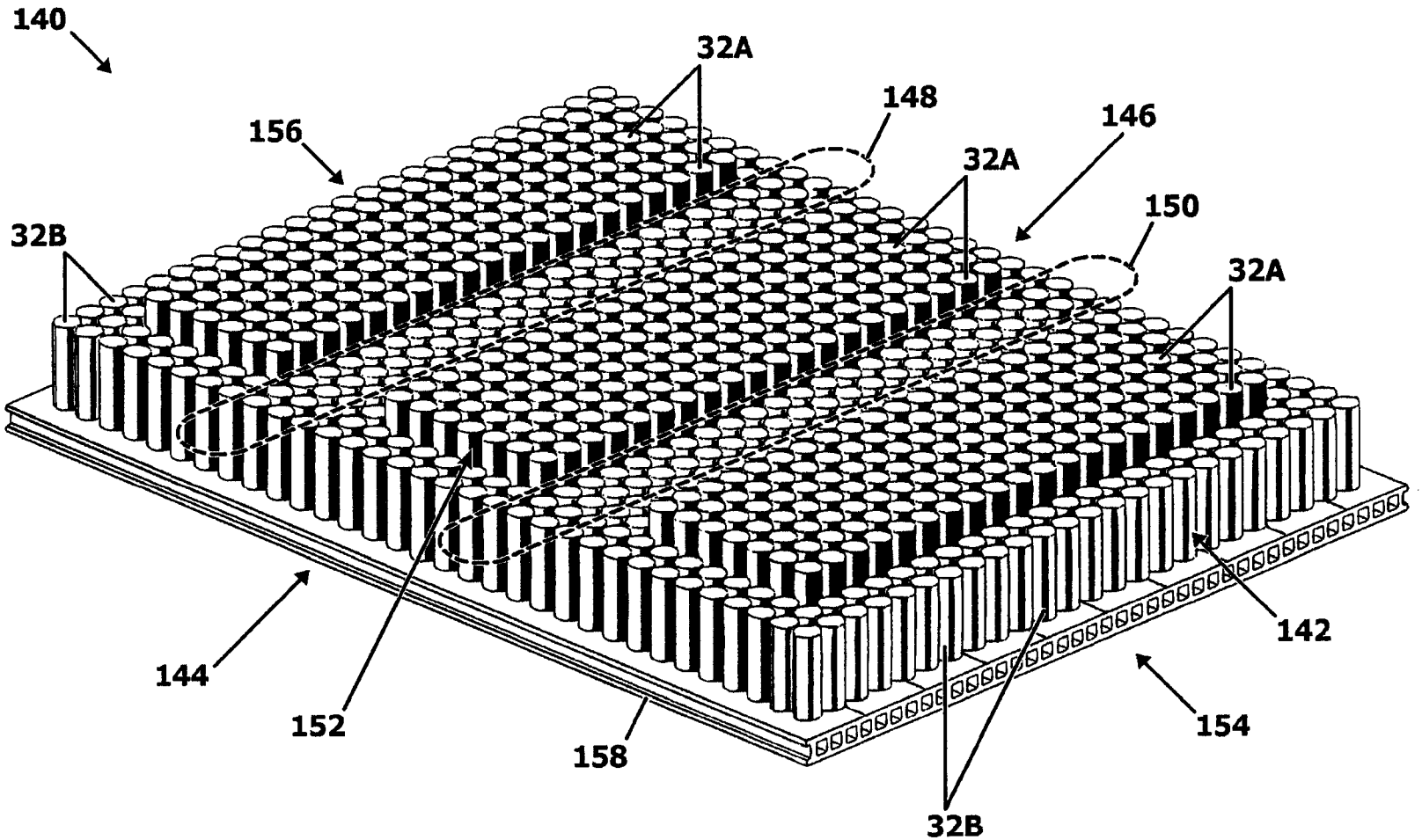
FIGS. 11A-11D are perspective views of an alternate stepped-edge innerspring assembly configured to receive one or more side-supports and lumbar supports, according to another embodiment.
Figure 11B:
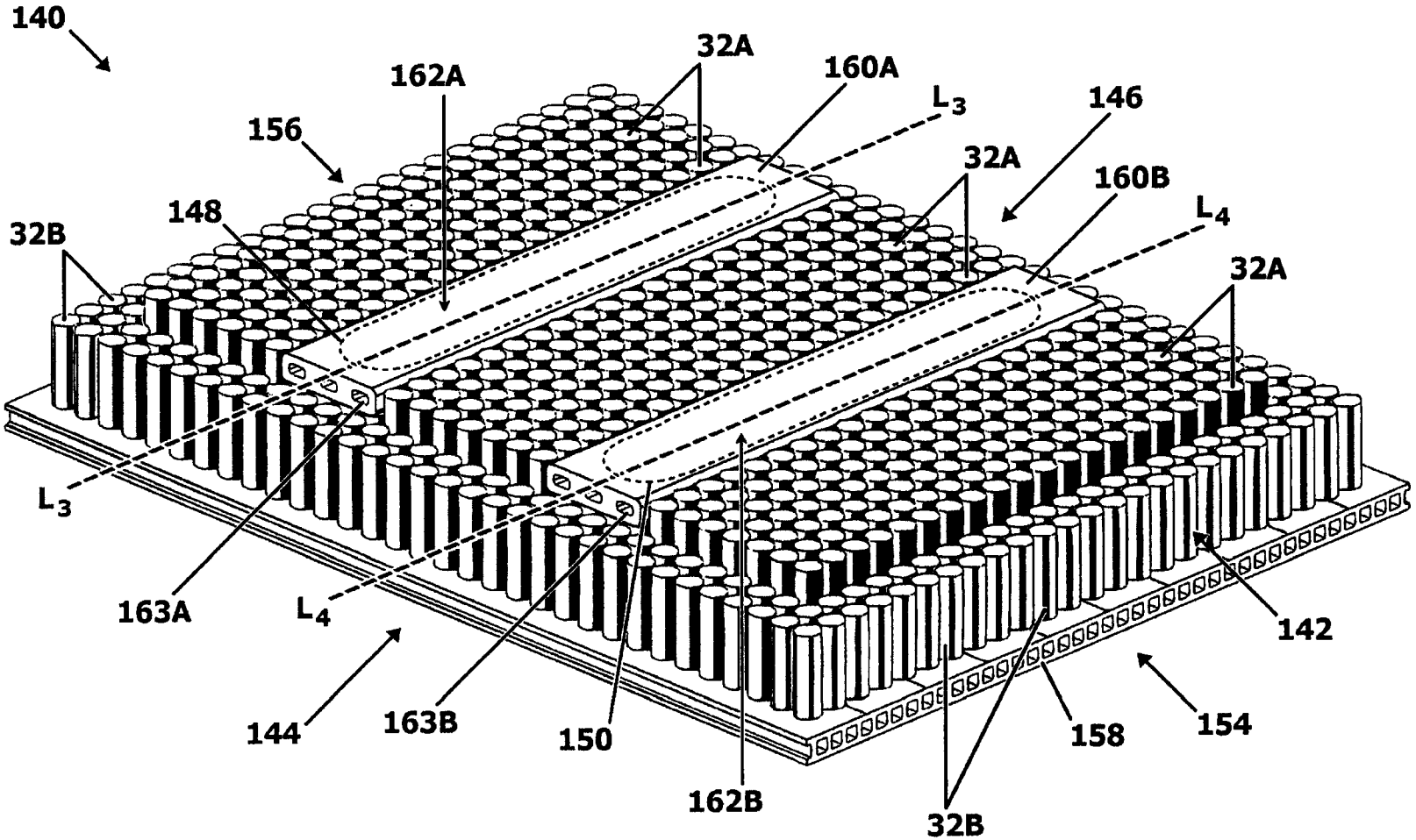

FIGS. 11A-11D are perspective views of another embodiment of a stepped-edge innerspring assembly 140 that includes both side-support members and lumbar support. As illustrated in FIG. 11A, the stepped-edge innerspring assembly 140 is illustrated. In this embodiment, taller and shorter pocketed coils 32A, 32B are still employed in the innerspring assembly 140 like embodiments previously discussed. However, the shorter pocketed coils 32B are not exclusively limited to a perimeter area 142 of the innerspring assembly 140. The shorter pocketed coils 32B are disposed in the perimeter area 142 and longitudinally across sides 144, 146 of the innerspring assembly 140 in two longitudinal sections 148, 150 to provide lumbar support in the innerspring assembly 140 as will be discussed in further detail below. Taller pocketed coils 32A are still disposed in an interior area 152 in the innerspring assembly 140, but are interdisposed between the two longitudinal sections 148, 150 and ends 154, 156 of the innerspring assembly 140. In this manner, support members can be disposed within the two longitudinal sections 148, 150 which cross through the interior area 152 between the sides 144, 146 to provide lumbar support within the interior area 152 of the innerspring assembly 140, as illustrated in FIG. 11B. Note that one or more than two longitudinal sections may also be provided as alternative designs in the innerspring assembly 140. Before discussing the lumbar support, it is noted that the pocketed coils 32A, 32B are disposed on a base 158 that may be the same or similar base as the base 34 previously discussed. All other features discussed previously with respect to the pocketed coils 32A, 32B and the base 34 are equally applicable for the innerspring assembly 140 of FIG. 11A and thus will not be repeated here.

FIG. 11B illustrates two lumbar support members 160A, 160B disposed in the longitudinal sections 148, 150. As illustrated, top portions 162A, 162B of the lumbar support members 160A, 160B are designed to be planar or substantially planar with the top surface of the taller pocketed coils 32A to provide a planar or substantially planar sleep surface in the innerspring assembly 140. The lumbar support members 160A, 160B may be extruded polymer foam like provided and previously discussed above for side-support members 44. The same options, features and materials may be provided for the lumbar support members 160A, 160B and thus will not be repeated here. The lumbar support members 160A, 160B may each also include one or more extruded longitudinal channels 163A, 163B disposed along longitudinal axes $L_3$ and $L_4$. The extruded longitudinal channels 163A, 163B may provide a further spring or spring-like effect in the lumbar support provided in the interior area 152. The lumbar support embers 160A, 160B may be attached to the top surface of the shorter perimeter coils 32B in the longitudinal sections 148, 150 using an adhesive or other fastener means.

Figure 11C:
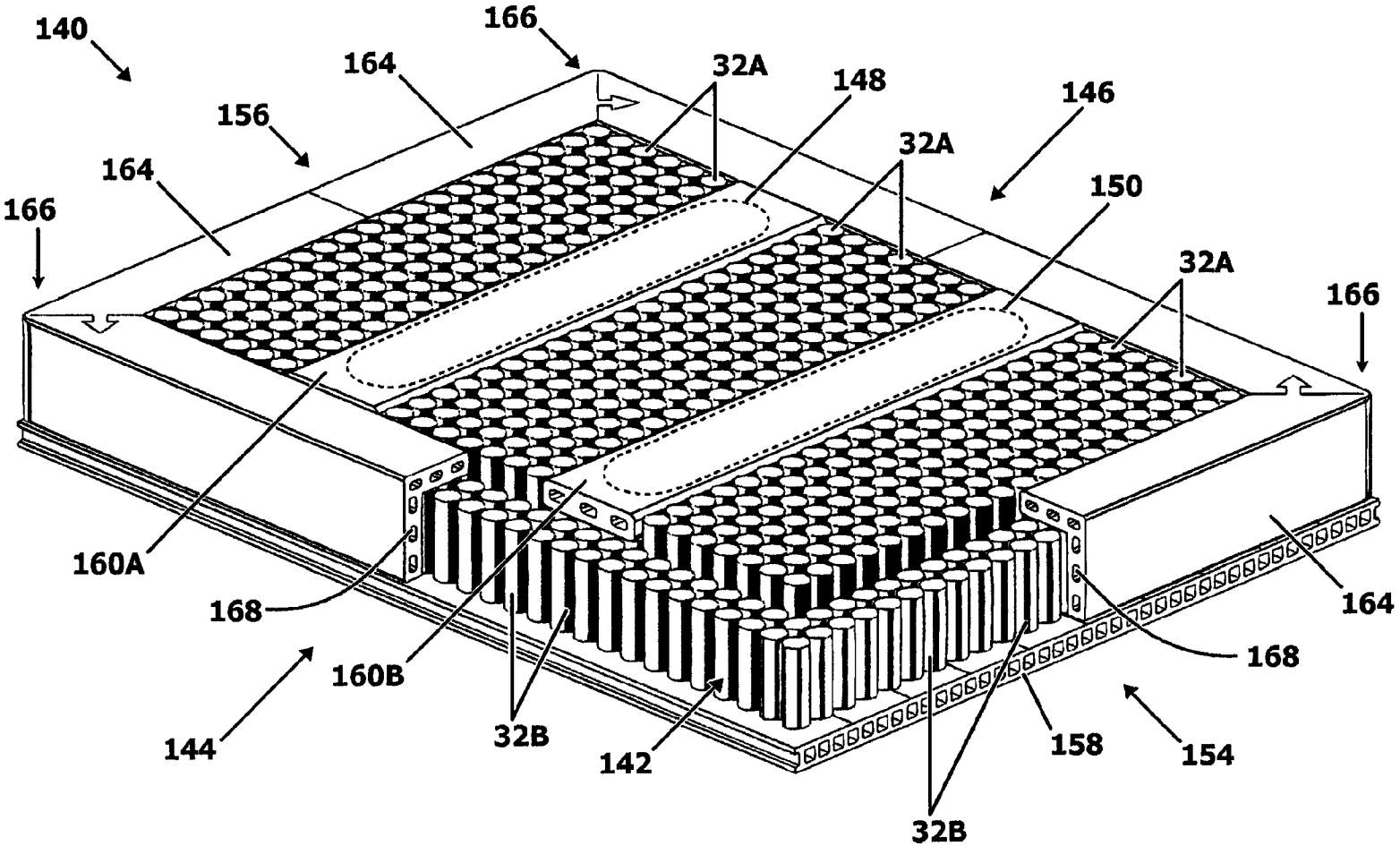
Figure 11D:
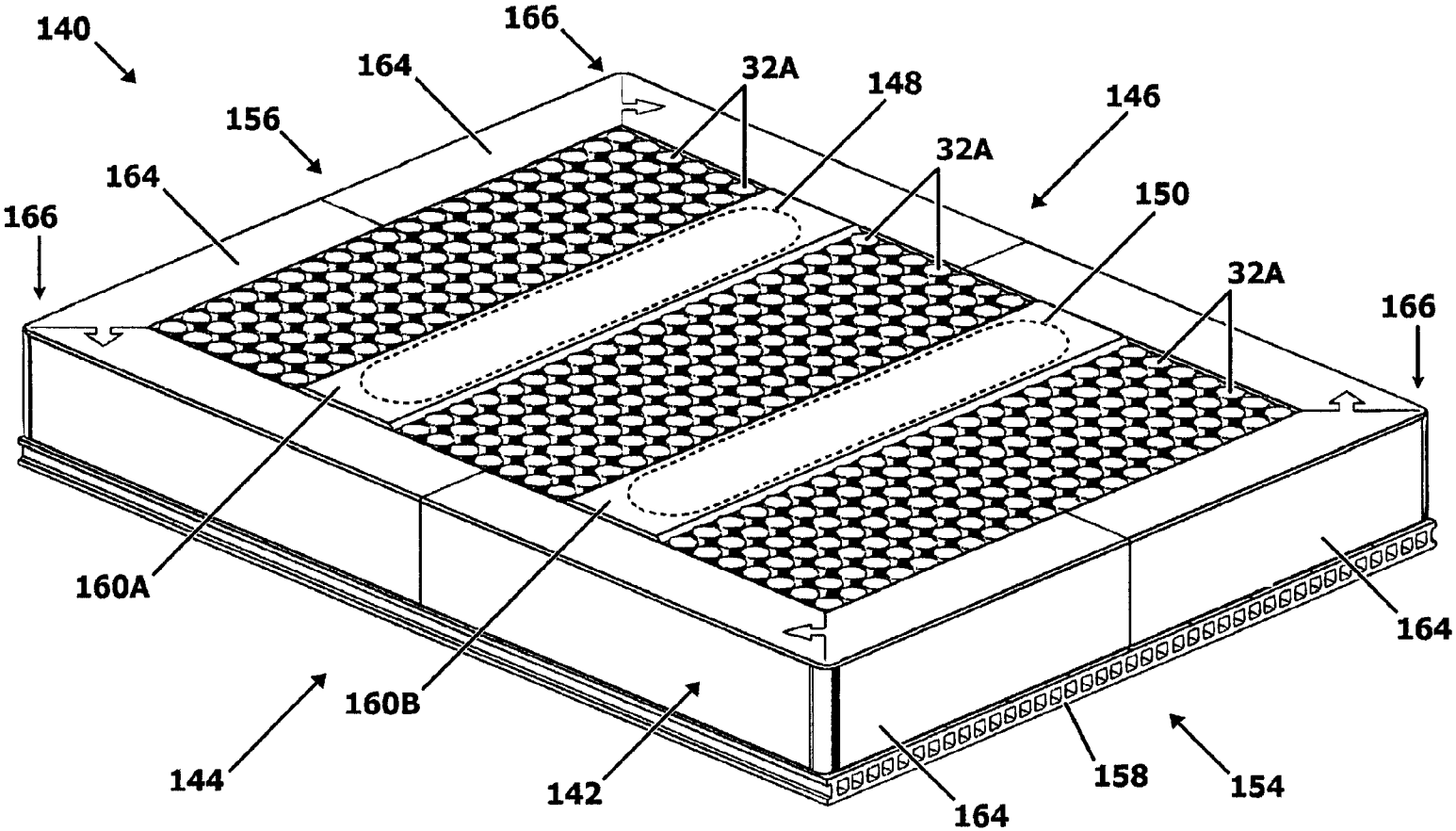

L-shaped side-support members 164 may be secured on top of the shorter perimeter coils 32B disposed in the perimeter area 142 of the innerspring assembly 140 to complete the assembly of the innerspring assembly 140. FIG. 11D illustrates the innerspring assembly 140 fully assembled with all L-shaped side-support members 164 and lumbar support members 160A, 160B installed to completely cover the shorter pocketed coils 32A in the perimeter area 142 and the longitudinal sections 148, 150 to provide a planar or substantially planar sleep surface with lumbar support provided by the lumbar support members 160A, 160B disposed across the interior area 152. As shown in FIG. 11C, the L-shaped side-support members 164 in this embodiment are designed to bend at approximately ninety (90) degree angles to fit around the corners 166 of the innerspring assembly 140; however any other type of side-support members, including but not limited to the L-shaped side-support members previously discussed above, may also be employed to provide edge-support for the innerspring assembly 140. Further, the L-shaped side-support members 164 may contain longitudinal extrusions 168 just as provided in previously discussed embodiments. Further, the innerspring assembly 140 could also be designed to provide a stair stepped-edge perimeter profile like provided in the innerspring assembly 110 of FIGS. 10A-H wherein stair stepped-edge support members are disposed around the perimeter area. Further, the innerspring assembly 140 could also be designed to provide a stepped-edge perimeter profile like provided in the innerspring assembly 30E of FIGS. 9A-9E wherein C-shaped side-support members are disposed on both the top and bottom of the shorter pocketed coils around the perimeter area.

Figure 12A:
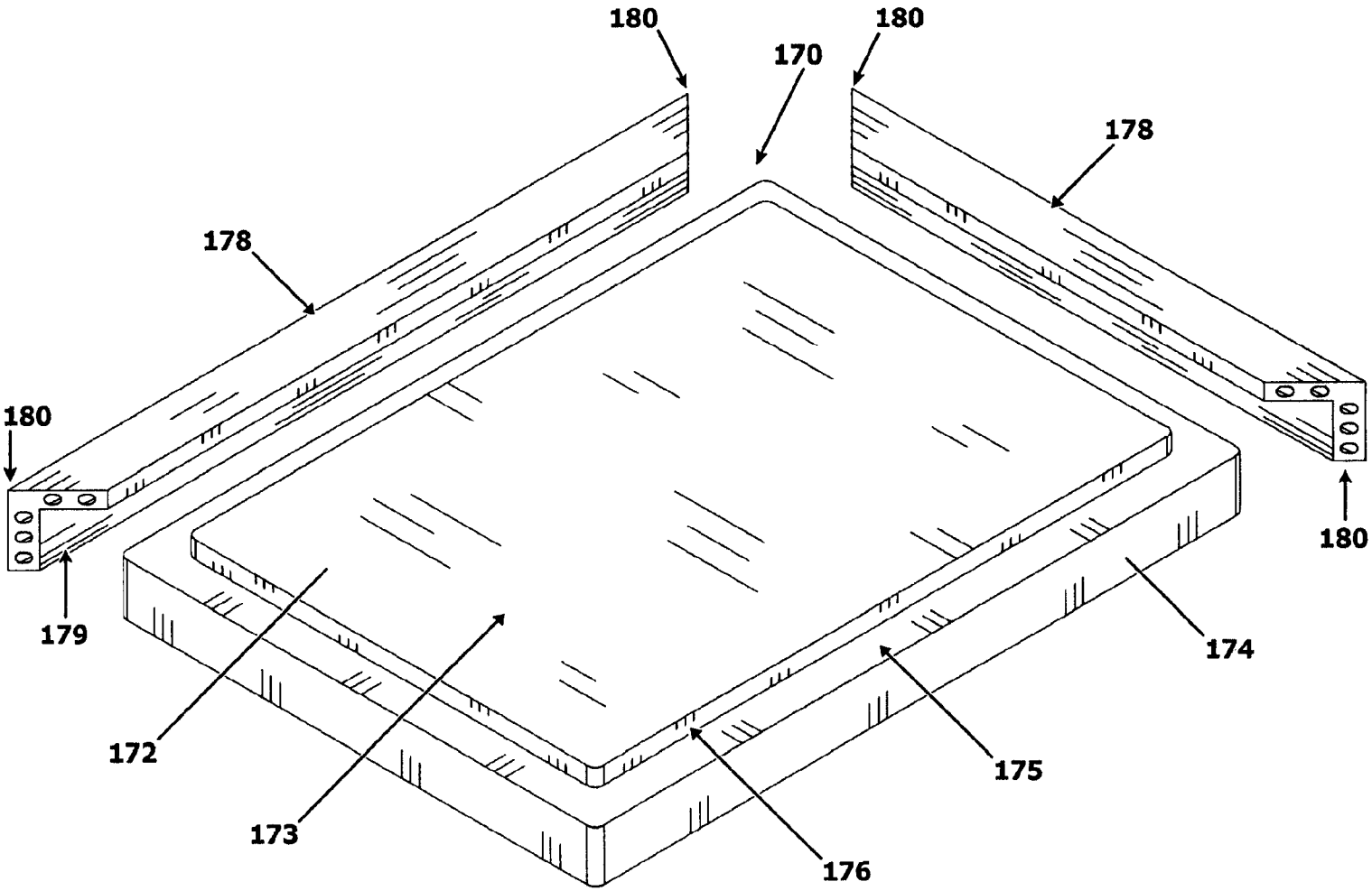
FIGS. 12A-12C are perspective views of a stepped-edge foam core with L-shaped side-support members installed on a perimeter of the stepped-edge foam core, according to another embodiment.
Figure 12B:
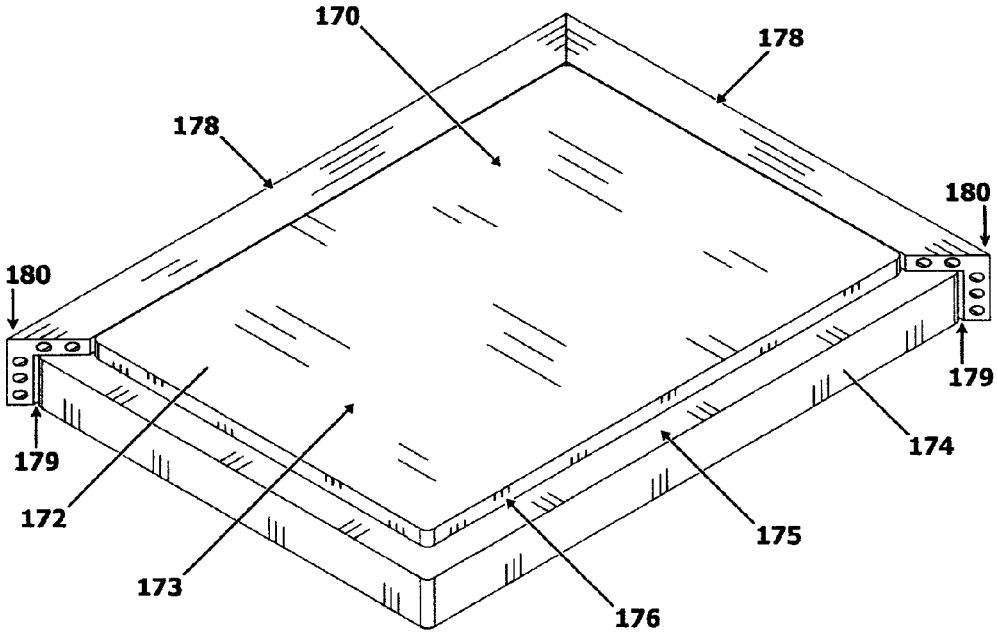
Figure 12C:
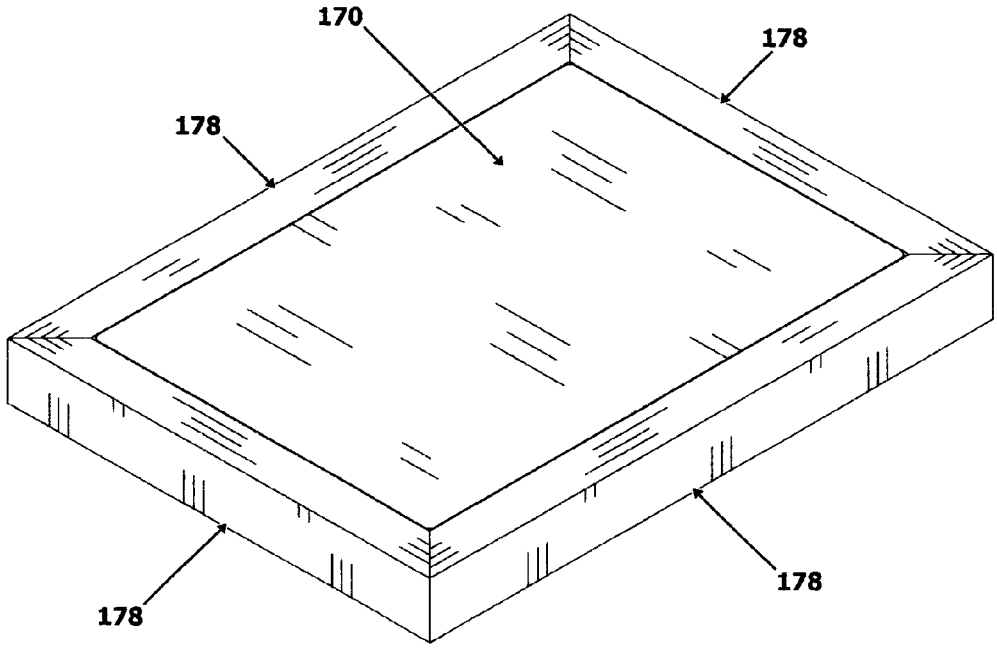

FIGS. 12A-12C are perspective views of a stepped-edge core 170 as an alternative to an innerspring assembly. In this regard, the aspects of this disclosure are not limited to an innerspring assembly. Bedding and seating assemblies may be comprised of core materials as opposed to innersprings. For example, core material could be latex or other thermoelastic materials, and may also be foamed. The core may also be comprised of a composite of a thermoplastic and thermoset materials. Examples of thermoplatics have been previously discussed above. One example of a thermoset material is latex foam rubber as one example of a thermoset elastomer. Latex rubber exhibits recovery and lack of compressive set characteristics while maintaining the tactile cushioning. It is a natural material and is considered biodegradable. Latex is hypo-allergenic, and breathes to keep you warm in the winter and cool in the summer. Further, bacteria, mildew, and mold cannot live in latex foam. It is generally obtained in emulsified form and is frothed to introduce air into the emulsion to reduce density and is then cured (vulcanized) to remove additional waters and volatiles as well as to set the material to its final configuration. Used in combination with a latex foam, thermoplastic foams can consume space within a cushion structure thereby displacing the heavier-weight, more expensive latex rubber foam component. The latex rubber foam component can also be further cost reduced through the addition of fillers such as ground foam reclaim materials, nano clays, carbon nano tubes, calcium carbonate, flyash and the like, but also corc dust as this material can provide for increased stability to reducing the overall density and weight of the thermoset material.

As illustrated in FIG. 12A, the core 170 is provided and could be formed from a poured mold, as an example. In this embodiment, the core 170 is comprised of an interior core 172 in an interior area 173 and a perimeter core 174 in a perimeter area 175. The transition between the interior core 172 and the perimeter core 174 forms a stepped-edge 176, similar to the stepped-edges for an innerspring previously discussed above. The interior core 172 and perimeter core 174 may be formed from either a monolithic core or two cores attached to each other to provide a stepped-edge 176. L-shaped side-support members 178 may be disposed around the perimeter area 175 of the core 170 to provide side-support for the core 170 just as previously discussed for innerspring assemblies described above. The L-shaped side-support members 178 may be the same as the L-shaped side-support members 44B illustrated in FIGS. 4A-4C and previously described above. During assembly, the L-shaped side-support members 178 can be disposed on the stepped-edge 176 provided by the core 170, as illustrated in FIG. 12B. The L-shaped side-support members 178 may contain a stepped-edge profile 179, as illustrated in FIGS. 12A and 12B. When each of the L-shaped side-support members 178 are disposed around the perimeter area 175 in the stepped-edge 176, the interior core 172 is completely encased within the L-shaped side-support members 178, as illustrated in FIG. 12C in this embodiment. As illustrated in FIGS. 12A-12C, corners 180 of the L-shaped side-support members 178 may be cut at angles, such as forty-five (45) degree angles, so that the corners 180 of the L-shaped side-support members 178 fit together. All other features discussed previously with respect to the innerspring assemblies and L-shaped side-support members may be applied to the core 170 and its components in FIGS. 12A-12C and thus will not be discussed again.

Those skilled in the art will recognize improvements and modifications to the embodiments disclosed herein. Many modifications and other embodiments of the invention set forth herein will come to mind to one skilled in the art to which the invention pertains having the benefit of the teachings presented in the foregoing descriptions and the associated drawings. These modifications include, but are not limited to the type of innerspring or core, its materials or compositions, including but not limited to whether exclusively thermoset or thermoplastic type materials or a composite of both, whether the innerspring contains spring coils, pocketed coils, or any other type of coil or spring, the form and shape of the perimeter side portions, the heights and other dimensions of any of the aforementioned components, etc. All such improvements and modifications are considered within the scope of the concepts disclosed herein.

Further, it is to be understood that the embodiments are not to be limited to the specific embodiments disclosed and that modifications and other embodiments are intended to be included within the scope of the appended claims. It is intended that the embodiments cover the modifications and variations of this invention provided they come within the scope of the appended claims and their equivalents. Although specific terms are employed herein, they are used in a generic and descriptive sense only and not for purposes of limitation.

What is claimed is:

1. A stepped-edge assembly for bedding or seating, comprising:

a base configured to support a weight of a user;

at least one interior area having an interior area height, and the at least one interior area comprises a plurality of coils supported by the base;

at least one perimeter area comprises a plurality of perimeter coils supported by the base, the plurality of perimeter coils disposed adjacent to the at least one interior area and having a perimeter area height shorter than the interior area height to provide at least one stepped-edge; and at least one side-support member having a stepped-edge profile formed by a top portion and a side portion, the top portion arranged perpendicular or substantially perpendicular to the side portion, the at least one side-support member surrounds the interior area height and the perimeter area height, the side portion of the at least one side-support member is not disposed on the plurality of perimeter coils, wherein the stepped-edge profile of the at least one side-support member is placed adjacent to at least a portion of the at least one stepped-edge to provide edge-support.

2. The stepped-edge assembly of claim 1, wherein the at least one perimeter area provides spring support to the at least one side-support member.

3. The stepped-edge assembly of claim 1, wherein a top surface of the at least one side-support member is planar or substantially planar with a top portion of the at least one interior area.

4. The stepped-edge assembly of claim 1, wherein the at least one side-support member is provided as a one-piece member.

5. The stepped-edge assembly of claim 1, further comprising one or more channels disposed through either the top portion, the side portion, or both the top portion and the side portion of the at least one side-support member.

6. The stepped-edge assembly of claim 5, further comprising at least one dowel disposed in at least one of the one or more channels configured to support interlocking of the at least one side-support member.

7. The stepped-edge assembly of claim 1, wherein the at least one side-support member further comprises a bottom portion disposed generally opposite of the top portion and perpendicular or substantially perpendicular to the side portion.

8. The stepped-edge assembly of claim 7, wherein the bottom portion is attached to the side portion.

9. The stepped-edge assembly of claim 7, further comprising one or more channels disposed through the bottom portion of the at least one side-support member.

10. The stepped-edge assembly of claim 1, further comprising at least one interlocking member disposed on an end of the at least one side-support member.

11. The stepped-edge assembly of claim 10, wherein the at least one interlocking member is comprised of at least one of a mitred edge and a notch.

12. The stepped-edge assembly of claim 1, further comprising a hinge disposed along a longitudinal axis in the at least one side-support member.

13. The stepped-edge assembly of claim 1, further comprising a hinge disposed between ends of the at least one side-support member, the hinge configured to bend around a corner of the at least one interior area.

14. The stepped-edge assembly of claim 13, further comprising interlocking members disposed on sides of the hinge and configured to interlock the ends of the at least one side-support member around the corner of the at least one interior area.

15. The stepped-edge assembly of claim 1, wherein the at least one side-support member is comprised of at least one corner side-support member configured to be placed around a corner of the at least one interior area.

16. The stepped-edge assembly of claim 1, wherein the top portion and the side portion of the at least one side-support member are provided as two pieces.

17. The stepped-edge assembly of claim 1, wherein the top portion of the at least one side-support member is attached to the side portion of the at least one side-support member via at least one of a tongue and groove, a weld, and an adhesive.

18. The stepped-edge assembly of claim 1, wherein the at least one side-support member is comprised of a plurality of side-support members each having at least one interlocking member, wherein each interlocking member of the plurality of side-support members is placed adjacent another interlocking member when placed adjacent the at least one interior area.

19. The stepped-edge assembly of claim 1, wherein the at least one interior area comprises four sides and the at least one perimeter area is comprised of four sides placed adjacent the four sides of the at least one interior area.

20. The stepped-edge assembly of claim 1, wherein the at least one perimeter area is comprised of a plurality of perimeter areas each having perimeter area heights shorter than the at least one interior area to provide at least one stair-stepped edge.

21. The stepped-edge assembly of claim 20, wherein the stepped-edge profile of the at least one side-support member is comprised of a stair-stepped profile placed adjacent the at least one stair-stepped edge to provide edge support.

22. The stepped-edge assembly of claim 1, wherein the at least one interior area is comprised of a plurality of interior areas separated by at least a portion of the at least one perimeter area.

23. The stepped-edge assembly of claim 22, further comprising at least one support member disposed in the at least a portion of the at least one perimeter area.

24. The stepped-edge assembly of claim 23, wherein the at least one support member is supported by the at least a portion of the at least one perimeter area so as to be planar or substantially planar with the plurality of interior areas.

25. The stepped-edge assembly of claim 1, wherein the at least one interior area and the at least one perimeter area are disposed on top of the base.

26. The stepped-edge assembly of claim 1, wherein the at least one interior area being a first portion of an innerspring and the at least one perimeter area being a second portion of the innerspring.

27. The stepped-edge assembly of claim 1, wherein the plurality of coils of the at least one interior area is comprised of at least one of: (a) a plurality of pocketed coils; and (b) a plurality of coil springs.

28. The stepped-edge assembly of claim 1, wherein the plurality of perimeter coils of the at least one perimeter area is comprised from at least one of: (a) a plurality of pocketed coils; and (b) a plurality of coil springs.

29. The stepped-edge assembly of claim 1, wherein the at least one interior area is comprised of a core.

30. The stepped-edge assembly of claim 29, wherein the core is comprised of at least one of latex and a viscoelastic foam.

31. The stepped-edge assembly of claim 1, wherein the at least one side-support member is comprised of a polymer foam.

32. The stepped-edge assembly of claim 1, wherein the at least one side-support member is comprised of at least one of a polystyrene, a polyefin, a polyethylene, a polybutane, a polybutylene, a polyurethane, a polyester, an ethylene acrylic copolymer, an ethylene-vinyl-acetate copolymer, an ethylene-methyl acrylate copolymer, an ethylene-butyl-acrylate copolymer, an ionomer, a polypropylene, and copolymers of polypropylene.

33. The stepped-edge assembly of claim 1, wherein the interior area height is five to three hundred fifty percent (5-350%) taller than the perimeter area height.

34. The stepped-edge assembly of claim 1, wherein the at least one perimeter area is disposed between the at least one interior area and the at least one side-support member.

35. The stepped-edge assembly of claim 1, wherein the side portion of the at least one side-support member extends down a side profile of the plurality of perimeter coils to rest on the base.

36. A stepped-edge assembly for bedding or seating, comprising:

at least one interior area comprising a plurality of coils having an interior area height, the plurality of coils including a top interior portion and a bottom interior portion opposite the top interior portion, the plurality of coils configured to transfer a first portion of a weight of a user from the top interior portion to the bottom interior portion;

at least one perimeter area comprising a plurality of perimeter coils which are adjacent to the plurality of coils, the plurality of perimeter coils including a top perimeter surface and a bottom perimeter surface opposite the top perimeter surface, the plurality of perimeter coils including a perimeter area height, the plurality of perimeter coils configured to transfer a second portion of the weight of the user from the top perimeter surface to the bottom perimeter surface, the top perimeter surface being disposed lower than the top interior portion of the plurality of coils to provide at least one stepped-edge; and at least one side-support member having a stepped-edge profile formed by a top portion and a side portion, the top portion arranged perpendicular or substantially perpendicular to the side portion, the at least one side-support member configured to transfer the second portion of the weight of the user to the top perimeter surface of the plurality of perimeter coils, wherein the stepped-edge profile of the at least one side-support member is placed adjacent to at least a portion of the at least one stepped-edge to provide edge-support.

37. The stepped-edge assembly of claim 36, wherein the at least one side-support member surrounds the interior area height and the perimeter area height.

38. The stepped-edge assembly of claim 36, wherein a top surface of the at least one side-support member is planar or substantially planar with the top interior portion of the at least one interior area.

* * * * *